US008721434B2

(12) United States Patent
Nelson et al.

(10) Patent No.: US 8,721,434 B2
(45) Date of Patent: May 13, 2014

(54) CONTACTING INTERNET THROUGH PLAYER MOBILE DEVICE

(75) Inventors: Dwayne R. Nelson, Las Vegas, NV (US); Steven G. Lemay, Reno, NV (US)

(73) Assignee: IGT, Reno, NV (US)

( * ) Notice: Subject to any disclaimer, the term of this patent is extended or adjusted under 35 U.S.C. 154(b) by 236 days.

(21) Appl. No.: 13/333,623

(22) Filed: Dec. 21, 2011

(65) Prior Publication Data

US 2013/0165208 A1 Jun. 27, 2013

(51) Int. Cl.
*A63F 9/24* (2006.01)

(52) U.S. Cl.
USPC ..... 463/25; 463/29; 463/42

(58) Field of Classification Search
USPC ..... 463/25, 29, 42
See application file for complete search history.

(56) References Cited

U.S. PATENT DOCUMENTS

| | | | | |
|---|---|---|---|---|
| 6,676,522 | B2 | 1/2004 | Rowe et al. | |
| 7,611,409 | B2 | 11/2009 | Muir et al. | |
| 2004/0110564 | A1 | 6/2004 | Kern et al. | |
| 2005/0192099 | A1 | 9/2005 | Nguyen et al. | |
| 2007/0202941 | A1 | 8/2007 | Miltenberger et al. | |
| 2008/0076572 | A1 | 3/2008 | Nguyen et al. | |
| 2009/0098943 | A1 | 4/2009 | Weber et al. | |
| 2009/0325686 | A1 * | 12/2009 | Davis et al. | 463/25 |
| 2011/0153436 | A1 | 6/2011 | Krampe | |
| 2012/0270639 | A1 * | 10/2012 | Walker et al. | 463/25 |
| 2012/0283006 | A1 * | 11/2012 | Baerlocher et al. | 463/27 |
| 2013/0084994 | A1 * | 4/2013 | Farrar | 463/42 |
| 2013/0102372 | A1 * | 4/2013 | Lutnick et al. | 463/13 |
| 2013/0116038 | A1 * | 5/2013 | Alderucci et al. | 463/25 |

FOREIGN PATENT DOCUMENTS

| | | |
|---|---|---|
| WO | WO 01/73575 | 10/2001 |
| WO | WO 2005/031626 | 4/2005 |

OTHER PUBLICATIONS

Search Report and Written Opinion for European Application No. 12198141.9, dated Apr. 5, 2013, 7 pages.
U.S. Appl. No. 13/156,903, filed Jun. 9, 2011.
U.S. Appl. No. 13/157,166, filed Jun. 9, 2011.
U.S. Appl. No. 13/217,105, filed Aug. 24, 2011.
U.S. Appl. No. 13/217,110, filed Aug. 24, 2011.
U.S. Appl. No. 13/220,430, filed Aug. 29, 2011.
U.S. Appl. No. 13/333,659, filed Dec. 21, 2011.
U.S. Appl. No. 13/333,669, filed Dec. 21, 2011.
U.S. Appl. No. 13/333,679, filed Dec. 21, 2011.
U.S. Appl. No. 13/299,199, filed Nov. 17, 2011.
U.S. Appl. No. 13/229,494, filed Sep. 9, 2011.
U.S. Appl. No. 13/229,507, filed Sep. 9, 2011.
U.S. Appl. No. 13/229,536, filed Sep. 9, 2011.
U.S. Appl. No. 13/231,275, filed Sep. 13, 2011.

(Continued)

*Primary Examiner* — Pierre E Elisca
(74) *Attorney, Agent, or Firm* — Foley & Lardner LLP

(57) ABSTRACT

A gaming system including wager-based electronic gaming machines compatible with mobile devices, such as smart phones or tablet computers, is described. The electronic gaming machines can be configured to establish temporary communication connections with mobile devices. After a communication connection is established with a mobile device, the EGM can be configured to utilize the network access capabilities of the mobile device to access a wide area network, such as the Internet. In one embodiment, the EGM can be configured to push data, such as fault condition data, to a remote device via the wide area network connection. In another embodiment, owners of the mobile devices, which can be a player playing the EGM, can receive incentives for allowing the EGM to utilize its network access capabilities.

29 Claims, 10 Drawing Sheets

(56) References Cited

OTHER PUBLICATIONS

U.S. Appl. No. 13/308,213, filed Nov. 30, 2011.
U.S. Appl. No. 13/308,160, filed Nov. 30, 2011.
U.S. Appl. No. 13/335,652, filed Dec. 22, 2011.
U.S. Appl. No. 13/306,911, filed Nov. 29, 2011.
U.S. Appl. No. 13/361,601, filed Jan. 30, 2012.
U.S. Appl. No. 13/335,613, filed Dec. 22, 2011.
U.S. Appl. No. 13/426/479, filed Mar. 21, 2011.

* cited by examiner

CONTACTING INTERNET THROUGH PLAYER MOBILE DEVICE

BACKGROUND

1. Field of the Described Embodiments

The described embodiments relate generally to gaming systems, such as gaming systems deployed in a casino enterprise. More particularly, apparatus and method for using a mobile device with a wager-based electronic gaming machine are described.

2. Description of the Related Art

In the casino gaming industry, wager-based electronic gaming machines (EGMs) are linked to remote devices to implement a number of different applications. For example, EGMs can be linked to a central server to allow accounting data, such as coin-in and coin-out, to be retrieved from the EGMs. This data can be used to evaluate the performance of particular EGMs or groups of EGMs, such as all of the EGMs, located in a particular casino. If an EGM includes a player tracking device that allows the identity of individual players to be determined, then the accounting data can be associated with identified players. This data can provide a basis for evaluating and rewarding players based upon how much revenue they bring into a casino.

In another networking application, EGMs can be linked to a central server to contribute to a progressive jackpot. A portion of each wager on EGMs linked in this manner contributes to the value of the progressive jackpot, which increases over-time. Varying sized groups of EGMs are linked to form progressive jackpot systems. For example, a group of EGMs within a casino, such as a bank of EGMs, can be linked together to contribute to a progressive jackpot that can only be won within the casino. As another example, EGMs within different casinos can be linked together to form a progressive jackpot system, such as a state wide progressive jackpot system like IGT's Megabucks™ progressive system.

In yet another networking application, EGMs can be linked to a central server to allow printed ticket vouchers to be issued and redeemed. A printed ticket voucher redeemable for credits issued at one EGM connected to the central server can be deposited into a second EGM connected to the central server and redeemed for game play credits on the second EGM. The central server keeps track of the printed voucher ticket vouchers as they are issued and redeemed so that each printed ticket voucher is only redeemed for credits once. These systems are usually referred to as Ticket-in/Ticket-out (TITO) systems.

Typically, groups of EGMs are linked to remote devices, such as a TITO server or an accounting server, via one or more private networks within a particular gaming venue, such as within a particular casino. Remote devices allowed to connect to an EGM, such as a TITO server or an accounting server, are typically located on or near the casino premises to allow it to easily connect to a private network including the EGMs. In the case where EGM do contribute data to and receive data from a device outside the casino, such as a progressive system server, the data that is allowed to be sent or received at the EGMs is very limited and well defined to limit possible tampering.

The information retrieved from EGMs, such as accounting data and TITO data, is closely guarded for competitive and security purposes. The use of a private network isolated to a particular casino limits the accessibility of the network and the EGMs coupled to the network to outside devices. The limited accessibility to the network can reduce the likelihood of the data being retrieved or EGMs being manipulated by unauthorized individuals. The limited accessibility of EGMs within a casino to devices outside of the casino is likely to be common practice for the foreseeable future. However, for some applications, it may be beneficial to allow an EGM to access a device located outside of the casino, such as a device connected to the Internet, under certain circumstances. In view of the above, methods and apparatus for linking EGMs to remote devices outside of a casino's private network are desirable.

SUMMARY OF THE DESCRIBED EMBODIMENTS

A gaming system compatible with patron-controlled mobile devices, such as smart phones, netbooks, laptops, tablet computers, smart cards and memory sticks, is described. The gaming system can include gaming devices, such as electronic gaming machines and system servers. The electronic gaming machines (EGMs) can be configured accept cash or an indicia of credit that can be used to make wagers on the wager-based games. The EGMs can be deployed in a regulated casino environment.

In one embodiment, the EGMs can be configured to establish secure communications with mobile devices, such as mobile devices carried by users or operators of the EGMs. For instance, a secure Bluetooth™ pairing can be established between the EGM and a mobile device or a secure wired communication connection can be established between the mobile device and the EGM. Once secure communications are established with a mobile device, the EGM can be configured to access Internet capabilities available on the mobile device to contact a remote device, such as a server controlled by the device manufacturer.

When communication connections are established through the user controlled mobile devices, the EGM can be configured to operate under the conditions that connections via mobile devices may not be available on demand and may be temporary in nature. For user controlled mobile devices, established communications between an EGM and a remote device facilitated by a wide area network connection provided by the user-controlled mobile device may terminate at the whim of the user. For instance, an established communication connection between and EGM and a remote device can be terminated when a user decides, for any reason, to leave the vicinity and move out of communication range with an EGM to which a communication has been established. As another example, an established communication connection facilitated by the mobile device can be terminated when a user decides to power-off their device or the device runs out of power.

In one embodiment, the EGM can be configured to send hardware and software fault condition data that can be used to analyze fault conditions that have occurred on the EGM via the Internet capabilities provided by a mobile device. For instance, data associated with a core dump that has occurred in the game controller can be sent to a remote device via a mobile device coupled to the EGM so that the fault condition can be analyzed. In another embodiment, the EGM can be configured to receive data from a remote device through the wide area network connection established via the mobile device. For instance, a software patch that fixes a fault condition can be received at the EGM via the wide area network connection and installed on the EGM.

Incentives can be provided to users for letting the casino utilize network data bandwidth, cellular network bandwidth, associated with their mobile device. For instance, users can earn cash, player tracking points and/or game play credits depending on the amount of data successfully transferred via their mobile device. In a particular embodiment, an application executable on the user's mobile device can be provided. The application may allow a user to opt-in/opt-out to the data transfer process, select desired incentives and select transfer parameters, such as overall data caps for a particular time period that are allowed and maximum data package sizes that can be transferred via their mobile device.

One aspect of the described embodiments is related to a method in a wager-based electronic gaming machine (EGM) including a game controller. The method can be generally characterized as comprising: 1) initializing the EGM including establishing communications between a first electronic device and the game controller via a private local area network where access to a wide area network is not available to the EGM via the private local area network; 2) instantiating a game play mode wherein wager-based game play is available on the EGM; 3) sending accounting data associated with a play of a wager-based game to the electronic device only via the private local area network; 4) storing data to a data store where the data doesn't include the accounting data; 5) establishing a first secure communication connection with a mobile device; 6) establishing a second secure communication connection with a second electronic device located on a wide area network using wide area network capabilities provided by the mobile device; 7) sending via the first and the second secure communication connections the data in the data store to a second electronic device and 8) ending the communication connections with mobile device.

A second aspect of the described embodiments is related to a wager-based electronic gaming machine (EGM). The EGM can include a cabinet, a first communication interface, a second communication interface and a gaming controller. The game controller can include a processor and a memory. It can be disposed within the cabinet and coupled to the first communication interface and the second communication interface. The first communication interface can be configured to allow the game controller to communicate with a first electronic device via a private local area network where access to a wide area network is not available to the EGM via the private local area network. The second communication interface can be configured to allow the game controller to establish a temporary communication connection with a mobile device. In one embodiment, the mobile device can be controlled by a user engaged in game play on the EGM.

The game controller can be configured to 1) receive an input signal from an input device on the EGM indicating a wager on an outcome to a wager-based game; 2) determine the outcome to the wager-based game including an award amount; 3) generate a plurality of commands for controlling output devices coupled to the game controller to generate a presentation for the wager-based game that reveals the determined game outcome; 4) generate accounting data associated with coin-in and coin-out from the EGM; 5) send the accounting data to the first electronic device only via the private local network; 6) generate a fault condition when communications with the first electronic device can't be established; 7) store a plurality of data items to a data store where the data store is not allowed to receive the accounting data; 8) establish a temporary communication connection with a mobile device; 9) establish a communication connection over the Internet with a second electronic device via the temporary communication connection; and 10) send one or more of the plurality of data items to the second electronic via the mobile device.

BRIEF DESCRIPTION OF THE DRAWINGS

The embodiments will be readily understood by the following detailed description in conjunction with the accompanying drawings, wherein like reference numerals designate like structural elements, and in which.

DESCRIBED EMBODIMENTS

Figure 1:
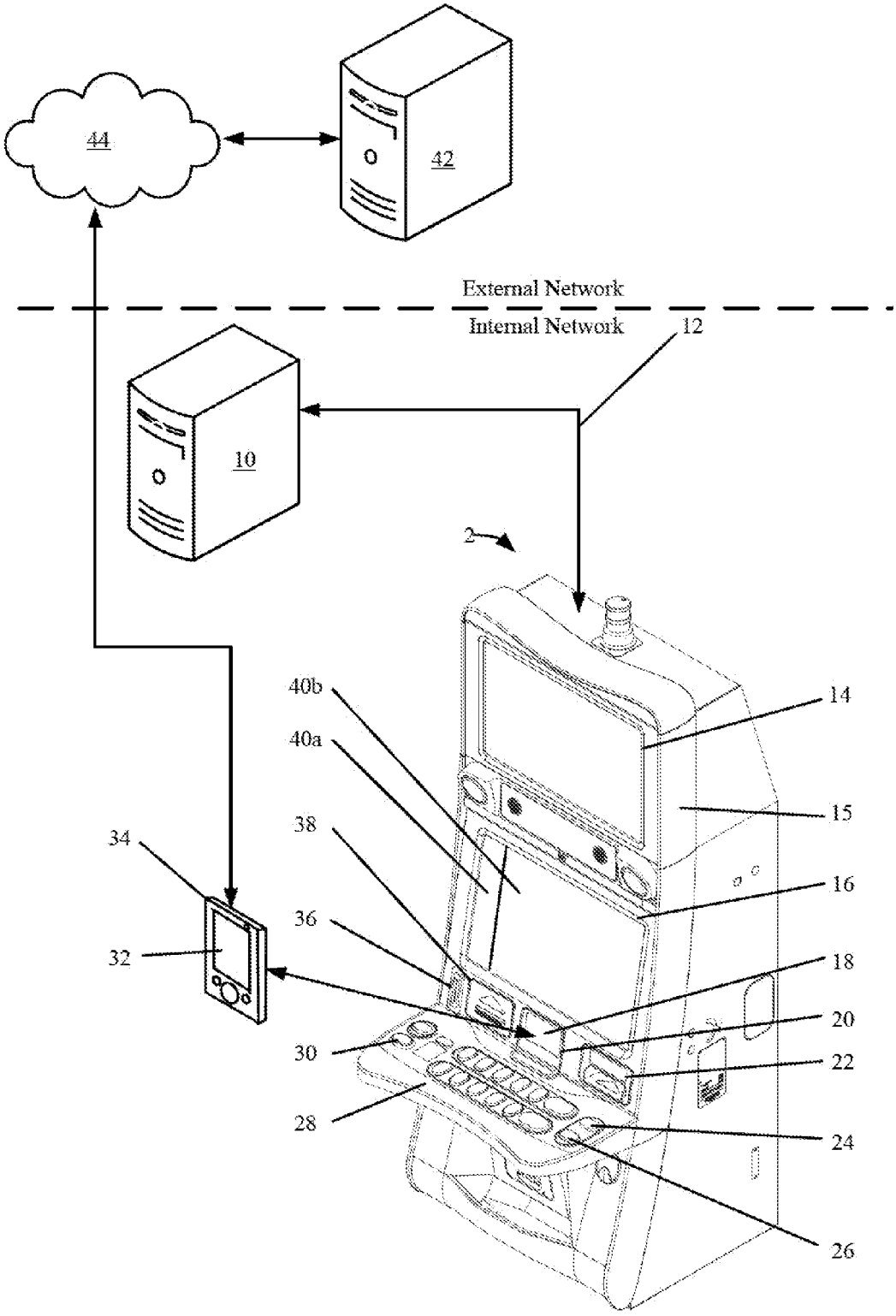
FIG. 1 is a perspective drawing of a gaming system including a wager-based gaming machine, a mobile device, a first server configured to communicate with the EGM via a private network and a second server configured to communicate with the EGM via a wide area network in accordance with the described embodiments.

In the following paper, numerous specific details are set forth to provide a thorough understanding of the concepts underlying the described embodiments. It will be apparent, however, to one skilled in the art that the described embodiments may be practiced without some or all of these specific details. In other instances, well known process steps have not been described in detail in order to avoid unnecessarily obscuring the underlying concepts.

A gaming system compatible with mobile devices controlled by users and/or of the gaming system is described. The gaming system can include a number of wager-based electronic gaming machines (EGMs). The EGMs can be configured to operate in a stand-alone mode or can be coupled to a private local network, such as local network within a casino. The private local network connection can be used to facilitate various functions, such as player tracking/accounting, bonusing, progressive games and ticket-in/ticket-out.

The EGMs may not have on-demand access to wide area networks, such as the Internet. However, the EGMs can be configured to establish a communication connection with a mobile device and use the mobile device's network capabilities to establish communications with a device coupled to a wide-area network, such as the Internet. In one embodiment, the remote device contacted through the wide area network can be controlled by a gaming machine manufacturer or an entity that provides repair services to the EGM. To aid in the repair and maintenance of the device, the EGM can be configured to push data, such as fault condition data, to the remote device. The fault condition data can be used to improve the operational performance of the EGMs and possibly identify EGMs in need of service.

With respect to the following figures, methods and apparatus that allow a mobile device to facilitate data transfers between an EGM and a remote device accessible via a wide area network are described. In particular with respect to FIG. 1, a gaming system including a wager-based gaming machine, a mobile device, a first server configured to communicate to the EGM via a private network and a second server configured to communicate with the EGM via a wide area network are described. The communications between the EGM and the second server can be facilitated via a mobile device controlled by a user or an operator of the EGM. With respect to FIGS. 2A, 2B and 2C, different communication scenarios between a server accessible through a wide area network and an EGM where mobile devices can facilitate the communications are described. Whether the mobile device is controlled by a user or a gaming machine operator/technician can affect the reliability of the connection, such as its length, the type of data that is transmitted via the connection and the functions implemented using the connection. As described above, the EGM can be configured to operate differently depending on whether the connection is determined to be relatively reliable or not. Some of the connection scenarios between an EGM and a mobile device are discussed with respect to FIGS. 2A, 2B and 2C.

Figure 3:
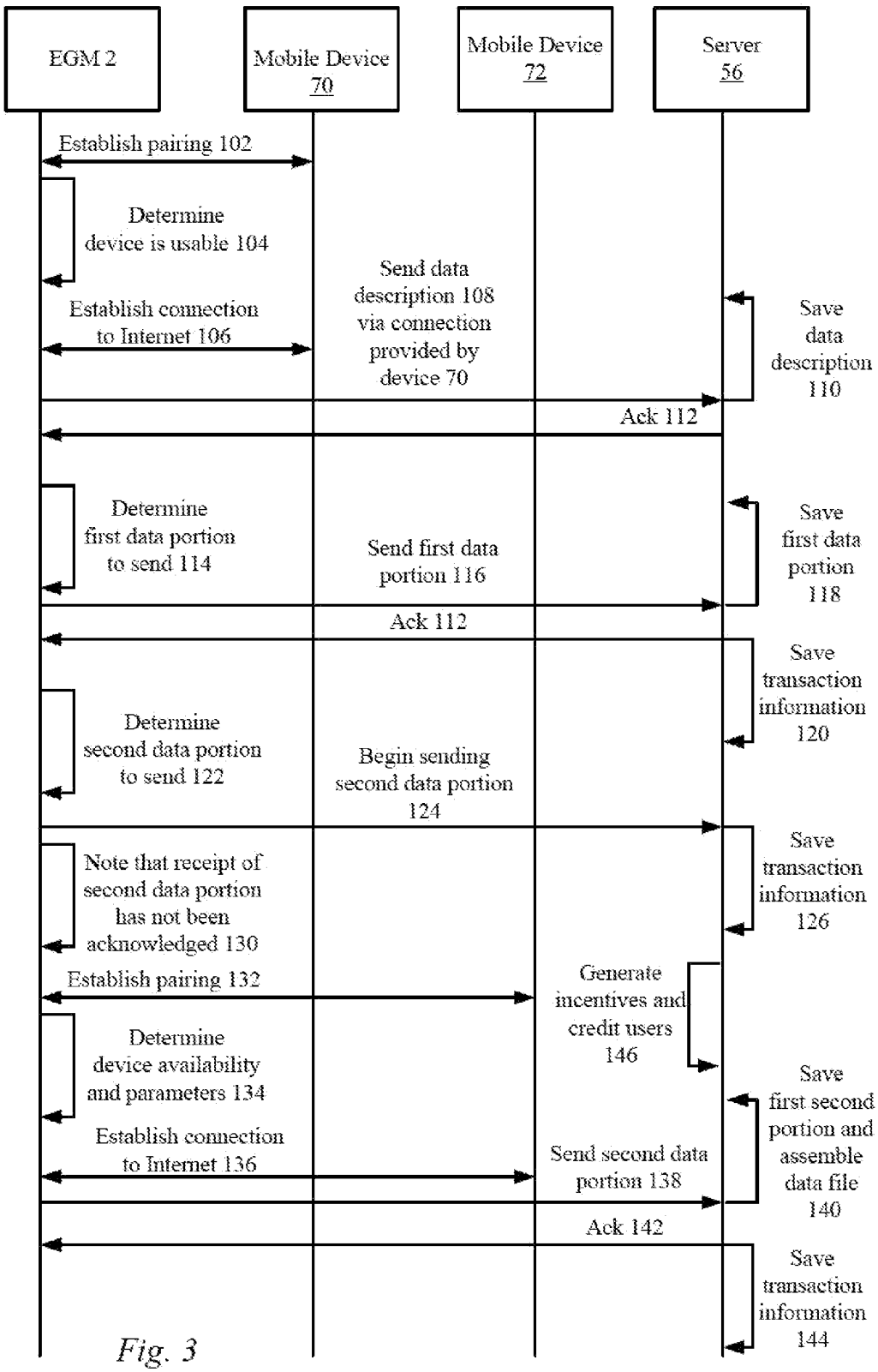
FIG. 3 is an interaction diagram between an EGM, multiple mobile devices and a remote server involving a transfer of data between the EGM and the remote server via the mobile devices in accordance with the described embodiments.

With respect to FIG. 3 an interaction involving an EGM, multiple mobile devices and a remote server is described. As described above, an EGM can be configured to divide a data file into multiple portions for transfer. As described with respect to FIG. 3, different portions of the file can be sent to a remote server via connections facilitated by multiple mobile devices in a parallel or serial manner A method in a wager-based EGM for repairing and maintaining the wager-based EGM is discussed with respect to FIG. 4. With respect to FIG. 5, a method in a wager-based EGM for sending data to a remote server via a mobile device facilitated connection is discussed. With respect to FIG. 6, a method in a server of receiving data from an EGM and providing incentives to mobile device users for facilitating the transfer is described. A method in a mobile device for facilitating a data transfer between a wager-based EGM and a remote server is discussed with respect to FIG. 7. Finally, further details of wager-based EGMs and gaming systems including these devices are described with respect to FIGS. 8 and 9.

FIG. 1 is a perspective drawing of a gaming system including i) a wager-based gaming machine 2, ii) a mobile device 34, ii) a first server 10 configured to communicate with the EGM via a private network 12 and iii) a second server configured to communicate with the EGM via a wide area network 44. The private local network 12 can be located within a gaming establishment, such as a casino. Multiple EGMs can be coupled to the private local network 12. The private local network 12 can be configured such that access to a wide area network, such as the Internet, is not available to the EGM 2 via the private local network. Via the private local network, the EGM can be configured to communicate with one or more servers providing functions, such as player tracking, accounting, TITO, bonusing and progressive gaming.

In some instances, the EGM 2 can be coupled to multiple private local networks within a gaming establishment, such as 12, that don't allow the EGM to access a wide area network. For instance, the EGM 2 can be connected to a first private local network that allows accounting and player tracking information to be transmitted between the EGM 2 and another device on the first private local network. In addition, the EGM 2 can be coupled to a second private local network that allows Ticket-in/Ticket-out (TITO) information to be transmitted between the EGM 2 and another device located on the second private local network.

The EGM 2 can be configured such that it expects the private local network 12 to always be available. For instance, when the EGM 2 is powered up, it can be configured to connect to private local network 12 and begin communicating with a remote device coupled to the network 12, such as server 10. When the EGM 2 can't i) connect to network 12 because of a problem with EGM 2, ii) communicate with server 10 because of a problem in the network 12 or iii) communicate because of a problem with server 10, the EGM can be configured to generate a fault condition. In response to determining a fault condition has occurred, the EGM 2 can enter into a non-operational state, such as a tilt state, where no game play is available on the EGM 2.

The EGM 2 can communicate information on the local private network, such as 12, using specific non-proprietary or proprietary communication protocols. For instance, the EGM 2 can be configured to communicate using a proprietary communication protocol, such as Netplex™ or non-proprietary protocols, such as SAS (Slot Accounting System) protocol or G2S (Game to Server) protocol. The protocols define what types of data and data formats can be communicated over the private local network 12. For instance, using SAS or G2S, accounting data, such as coin-in and coin-out, can be transmitted from an EGM to a server. Details of SAS and G2S can be obtained from the Gaming Standard Association (GSA), Fremont Calif. In particular embodiments, EGM 2 can be configured to communicate using one set of protocols, such as wager-based based specific protocols, over the private network and communicate with a different set of protocols, such as Hypertext Transfer Protocol Secure (HTTPS) when communicating over a wide area network connection facilitated via a mobile device.

As described above, the EGM 2 can be configured to establish a temporary communication with a mobile device, such as 34. The mobile device can have wide area network access capabilities, such as access to the Internet. First, the EGM 2 can detect the presence of the mobile device. Next, a secure communication session between the mobile device and the EGM 2 can be initiated. Then, a communication session can be established between the EGM 2 and a remote device coupled to a wide area network via the mobile device.

Prior to or after the communication session is established with the mobile device, the EGM 2 can be configured to attempt to determine whether the mobile device is associated with a user or an operator. For instance, the EGM 2 can receive device information from the mobile device during the mobile device detection process that allows the mobile device to be identified as an operator or a user controlled mobile device. Based upon the results of the determination, the EGM 2 can initiate different communication modes and functions depending on whether a device has been identified as a user controlled or operator controlled.

For instance, the EGM 2 can be configured to detect a mobile device, such as 34, is near the EGM 2 and is associated with a user engaging in game play at the EGM 2. Then, the EGM can establish a connection with a wide area network via the mobile device and begin communications with a remote device coupled to the wide area network. For instance, after establishing communications, the EGM can be configured to push data to the remote device, such as but not limited to fault condition data.

The EGM 2 can also be configured to access the current communication capabilities of the device, such as but not limited to 1) if it currently has an active network data connection, 2) the type of network connection (e.g., a cellular data connection or a Wi-Fi connection), 3) a bandwidth associated with the connection (e.g., 2G, 3G or 4G), 4) a current strength of the mobile device connection to the wide area network, 5) a type of connection to the mobile device (e.g., wired or wireless) and 6) a bandwidth of the connection between the EGM and the mobile device and 6). Based on these parameters, the EGM 2 can be configured to perform functions, such as estimating how long a data transfer might take and whether the connection appears to be reliable. The reliability of the connection can indicate whether the data transfer is likely to be completed or not. The EGM 2 may not initialize certain data transfers if the connection appears to be unreliable and the data transfer is not likely to be completed.

The EGM 2 can be configured to prepare to end a task or delay starting new tasks involving the communication connection provided by the mobile device, when particular events are detected on the EGM that indicates the user is likely to leave the EGM 2. For example, when the credits on the EGM 2 go to zero, the user has requested to cash out or the user has only deposited a small amount of funds, it is likely the user is going to leave the EGM 2 shortly and the connection with the mobile device will be lost. Thus, if the EGM 2 has completed or almost completed a transfer data when the cash out command is detected and has additional data to transfer before beginning a new data transfer, the EGM 2 may be configured to wait for conditions that indicate the mobile device is going to remain at the EGM 2 longer, such as the detection of an additional deposit of credits. If it is determined that the mobile device is likely leaving the vicinity of the EGM 2 in the near future, the EGM 2 may wait until a new connection is established with another mobile device before attempting additional network related tasks.

As an example of how the EGM 2 may be configured when connected to an operator controlled mobile device, the EGM 2 can be configured with a diagnostic mode that requires a connection to a remote device, such as server controlled by an EGM manufacturer or a regulator. The diagnostic mode may be enabled on the EGM 2 based upon information that is received from the remote device. For instance, the information received from the remote device may allow the EGM 2 to determine that the remote device is authorized for communications with the EGM 2. In one embodiment, the diagnostic mode can be used to diagnose a fault condition on the EGM 2. In another embodiment, it can be used to perform a regulatory function, such as determining software stored on the EGM 2 is authorized for use on the EGM 2. The remote device can be located and accessed on a wide area network 44, such as the Internet.

EGM-Mobile Device-User Interactions

Next with respect to FIG. 1, user interactions with EGM 2 that can lead to a communication connection between the EGM 2 and a mobile device, such as 34, are described. Further, connection schemes that can be utilized between the mobile device and the EGM 2 are described. A user with a mobile device 34 can approach EGM 2 to play a wager-based game. The EGM 2 includes an upper video display 14 and lower video display 16 disposed in a secure cabinet 15 with locking mechanisms. The lower video display 16 can be used to display video images associated with the play of a wager-based game, such as a game outcome presentation. The upper video display 14 can be used to display attract features and a bonus game outcome presentation that is triggered from the play of the wager-based game on the lower video display 14. One or both of the upper video display 14 and main display 16 can include touch screens.

In one embodiment, a portion of the video display screens can be allocated for control a remote device, such as server 10. The remote server 10 can control video content output the portion of the display it controls to provide additional features on the EGM 2. As an example of allowing a remote device to control a portion of the EGM display, video content for a portion 40*a* of display screen 16 can be controlled by server 10. Thus, the server 10 can send instructions and data that determine what content is output in portion 40*a*. The remaining portion 40*b* can be controlled by a game controller (not shown, see FIG. 8). In portion 40*b* and/or on display 14 as well, the game controller can output video content associated with the play of a wager-based game. As described above, server 10 can be coupled to the EGM 2 via private network 12.

To start game play, credits are first deposited on the EGM 2 that can be used for wagers. For instance, currency or a ticket voucher redeemable for credits can be inserted in bill acceptor 22. The ticket voucher can be validated by a remote server in the gaming system 10. As another example, information can be transferred from the mobile device 34 to the EGM 2 via an interface, such as wireless interface 18. The EGM 2 can include wireless and/or wired interfaces that enable communications between the EGM 2 and the mobile device 34 to be established.

The mobile device 34 can be configured as an electronic wallet and the information transfer can be used to initiate an electronic funds transfer that results in credits being deposited on the EGM 2. The use of the mobile device in for these transactions can alert the EGM 2 to the presence of the mobile device. In response to the use mobile device for these purposes, the EGM 2 may attempt to initiate communications with the mobile device that allow it to use the mobile device's wide area network access capabilities.

Whether credits are deposited via a tangible medium, such as a ticket voucher or paper currency, or electronically, such as via the mobile device 34, the user is likely to be near the front of the EGM 2. Thus, if they are carrying a mobile device, it is likely to be in the general area of the EGM 2. For example, the mobile device is likely to be at least an arm's length distance from the EGM 2. Thus, the EGM 2 can establish a connection with the mobile device 34 that can be used to facilitate a connection with a remote device via wide area networking capabilities provided by the mobile device 34.

After depositing credits, a player can make a wager and initiate a game on the EGM 2. The input panel 28, which can include mechanical buttons, such as 24, 26 and 28, can be used to make selections related to the play of the game, such as a wager amount, and initiate the game. After the game is initiated, a game outcome presentation can be generated on EGM 2. It can include video images output to the displays and accompanying sound effects. For example, during a video slot game played on EGM 2, the game controller can generate a game presentation including a series of video images that show at different times an amount wagered on the game, symbols moving and then stopping in a final position and an award amount associated with game based upon the amount wagered and the final position of the symbols.

In some instances, after depositing credits, typically before beginning game play, a player can initiate a player tracking session on the EGM 2. During a player tracking session, information associated with game play, such as amounts wagered and amounts won can be stored to a player tracking account. This information is often referred to as player tracking information. To encourage repeat business, gaming enterprises often provide complimentary awards ("comps"), such as free meals and lodging, to players. The value of the comp can depend on the value of the player to the casino based upon their player tracking information, such as amounts wagered over time.

The player tracking account can be associated with the user that has initiated game play on EGM 2 and can be hosted on a remote device, such as server. The player can initiate a player tracking session by providing player tracking account information that allows their player tracking account to be located on a device that hosts player tracking accounts. In one embodiment, the player tracking account information can be stored on the mobile device 34 and transmitted to the EGM via a compatible communication interface, such as wireless interface 18. In another embodiment, the player tracking account information can be stored on a card that can be read by card reader 36. In yet another embodiment, a service window application, such as an application output to display portion 40*a*, can be used to enter player tracking account information. When the mobile device is utilized to provide player tracking information, the EGM 2 can again be alerted to its presence and in response may attempt to initiate communications with the mobile device that allow it to use the mobile device's wide area network access capabilities.

In one embodiment, the EGM 2 can be configured to provide power charging capabilities to a mobile device, such via a wired connection or a wireless power mat. In response to the detection of the mobile utilizing its power charging capabilities, the EGM 2 can be configured to attempt to utilize the mobile device's wide area network access capabilities. In other embodiments, the EGM 2 can be configured to detect nearby mobile devices for the purposes of initiated an attract feature that encourages the player to engage in game play at the EGM 2. Thus, the EGM 2 can be aware of nearby mobile devices associated with users not using the EGM 2. These mobile devices may be associated with patrons walking near the EGM 2, standing near the EGM 2 or playing a game on a nearby gaming machine. The ability to detect or be made aware of nearby mobile devices can be provided independently of whether attract features are provided.

In general, when a nearby mobile device is detected or the EGM 2 is made aware of a nearby mobile device (e.g., another device may detect the presence of the mobile device and transmit the information to the EGM), the EGM 2 may attempt to establish communications with the device for the purposes of utilizing its wide area network capabilities. In some embodiments, the EGM 2 can be configured to contact and attempt to access the wide area network capabilities of a number of mobile devices simultaneously. For instance, the EGM 2 can be configured to contact a mobile device associated with a player utilizing the EGM 2 and a nearby mobile device of a player utilizing another EGM.

Wide area network capabilities on a mobile device can be enabled by the mobile device carrier. For example, Blackberry™, AT&T™, Verizon™, Sprint™ and T-mobile™ are examples of mobile device carriers. The data capabilities for a particular mobile device can depend on the network infrastructure maintained by the carrier, the capabilities of the mobile device and a voice/data plan selected by the user of the device.

For the one or more mobile devices, the EGM 2 or another device can be configured to determine whether the mobile device is likely to remain near the EGM 2. The devices determined to likely remain near the EGM 2 may be contacted first before a mobile device less likely to remain. For instance, the EGM 2 may attempt to contact a mobile device that has remained stationary for some time period versus a mobile device that is determined to be moving away from the EGM 2.

During game play, besides attempting communications over a wide area network using the mobile device, the EGM 2 can be configured to send information to the mobile device 34 that is for a player's personal use. For instance, the EGM 2 can be configured to send a copy of a screen displayed on 40*b* showing the outcome of the game. The player can save this screen copy as a keepsake and may optionally upload it to a social media site. Further, the EGM 2 can be configured to receive information from the mobile device that affects the game play. For instance, the EGM 2 can be configured to receive player tracking information, voucher information and/or player preference information that allows the gaming experience to be customized for a particular player. Thus, the EGM 2 can be configured to interact with a mobile device 34 to send data intended for storage on the mobile device as well as to send data to the mobile device that is intended for a remote device.

As described above, the EGM 2 can be configured to detect mobile devices carried by employees of the gaming operator that move throughout the casino floor and contact these devices for the purposes of utilizing their network access capabilities. These devices can transmit information that allows them to be identified by the EGM 2. In one embodiment, the EGM 2 can be configured to only utilize specially designated devices, such as devices carried by operator employees for the purposes of accessing and engaging in communications with devices on a wide area network, such as the Internet. In yet another embodiment, which is described in more detail below, user devices can be required to have a particular application installed, such as an application provided by the gaming operator, before the mobile devices can be utilized for accessing a wide area network.

In yet other embodiments, the EGM 2 can be configured with an operator activated feature that has to be activated before the EGM 2 is allowed to access a remote device via a wide area connection on a mobile device. For instance, the feature may only be activated when a lock requiring an operator key is activated on the EGM 2. In another embodiment, the EGM 2 can include a switch inside its cabinet and not accessible to users that must be actuated to allow the EGM to engage in communications with a remote device on the Internet via a mobile device.

In yet another embodiment, a wireless or wired interface can be located within the EGM cabinet that can be used to communicate with a mobile device. The EGM 2 can be configured such that the wireless or wired interface is only activated when the interior of the EGM 2 has been accessed in an authorized manner The EGM 2 may be configured to only permit communications via this interface when the EGM 2 is an operator mode, such as when the cabinet has been opened via an approved procedure. At other times, the EGM 2 may not be configured to communicate with remote device via a wide area network.

Mobile Device-EGM Interactions Facilitating an Internet Connection

Figure 2A:
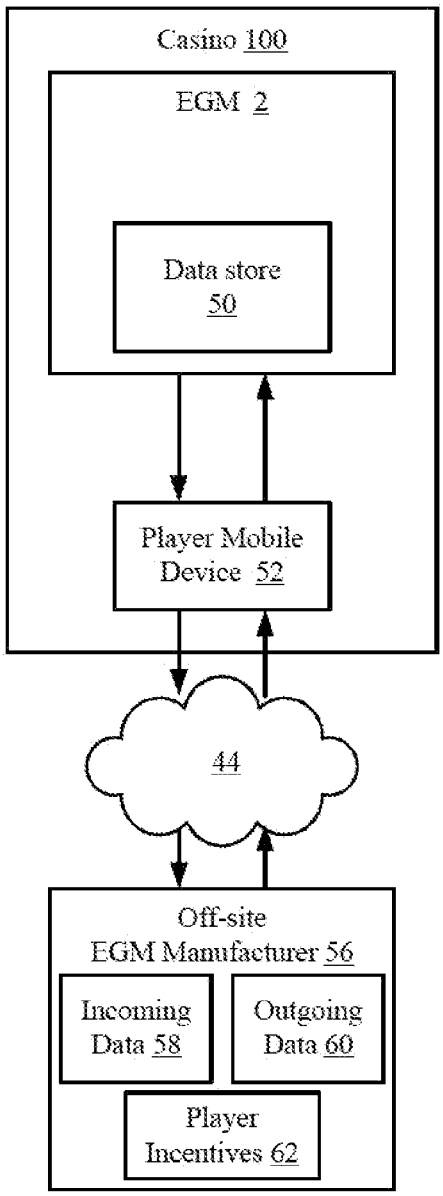
FIGS. 2A, 2B and 2C are block diagrams illustrating different communication couplings between a server accessible through a wide area network, an EGM and a mobile device that provides access to the wide area network in accordance with the described embodiments.
Figure 2B:
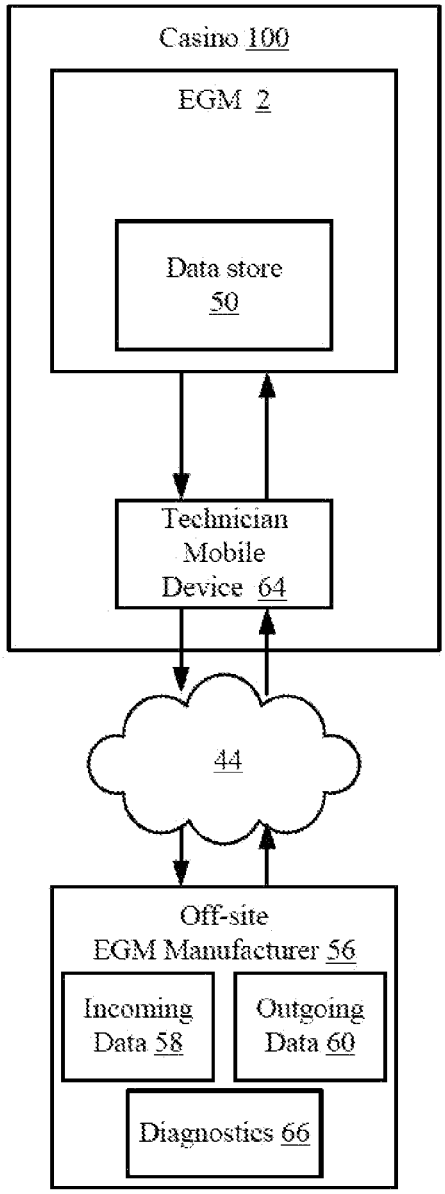
Figure 2C:
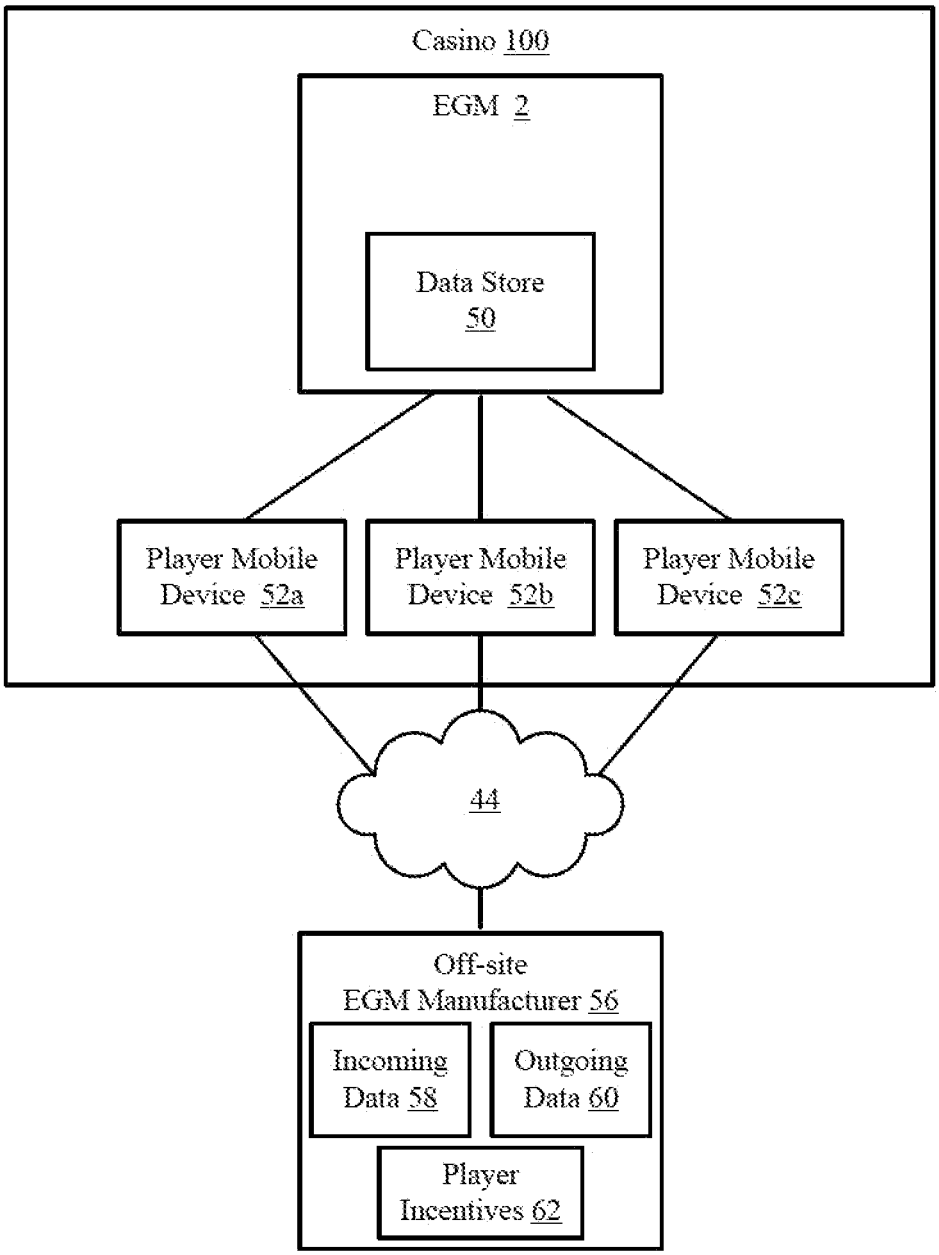

Next with respect to FIGS. 2A, 2B, 2C and 3, interactions between an EGM 2 and one or more mobile devices that facilitate communications between the EGM 2 and a remote device via a wide area network are described. FIGS. 2A, 2B and 2C are block diagrams illustrating different communication couplings between a server accessible through a wide area network, an EGM and a mobile device. In these embodiments, the mobile device can be used to provide access to a wide area network, such as the Internet.

In FIG. 2A, an EGM 2 located in a gaming establishment, such as casino 100, has established a communication connection with a mobile device 52. The mobile device 52 can be non-gaming operator controlled device, such as a mobile device controlled by a visitor to the casino 100. The mobile device 52 can be coupled to the EGM 2 via a wired or wireless communication connection. In one embodiment, the EGM 2 can be configured to establish a securing pairing, such as a Bluetooth™ pairing, with the mobile device.

The EGM 2 can include a data store 50 that stores a plurality of data items. The data store 50 can include data that it wishes to transfer to remote device accessible via wide area network, such as a server 56 controlled by an off-site manufacturer. In one embodiment, the data in data store 50 can be related to the performance of various devices on the EGM 2. For instance, if the EGM 2 has crashed and a core dump occurred, the data in data store 50 can be related to the core dump. The core dump can be used to determine what caused the crash. Typically, this type of data on EGMs deployed in the field is not readily available to gaming manufacturers. In another example, the data can be related to the performance of peripheral devices on the EGM, such as information related to rejected bills or tickets by the bill validator or information related to error conditions that have occurred in the peripheral device. An error condition on one of the peripheral devices may have resulted in a call to a technician to perform maintenance on the device, such as resetting the device or replacing the device.

In another example, data related to the operation of the EGM 2 can be stored in data store 50, such as a percentage of time that the EGM 2 has been used for game play, a number of times each button has been actuated, a number of times a touch screen input has been detected at a particular location, a number of tickets printed by a printer, a number of card read by a card reader or a number tickets accepted by a ticket printer. This type of data can be used to develop a maintenance schedule for the device.

The EGM 2 can be configured to maintain a log of the data that is stored in 50 including its type and whether it has been sent out. The EGM 2 can update the log each time new data is stored to 50 and data from 50 is transferred to a remote device. After data is transferred from the data store to a remote device, the EGM 2 can be configured to delete it or allow it to be overwritten by new data.

As described above, a casino can consider some operational data on an EGM, such as performance data related to coin-out/coin-in or customer information related to a loyalty program, as proprietary and secret information. The EGM 2 can be configured such that a transfer of proprietary and secret information via the mobile device 52 is not permitted. However, as described above, it can be transferred off the EGM 2 via a private local network that links the EGM 2 to operator controlled devices configured for receiving this information. In one embodiment, to verify it is not communicating proprietary and secret information over the wide area network, the EGM 2 can be configured to send a copy of the data sent to a remote device, such as a manufacturer controlled device, to a gaming operator controlled device. Via the copy of the data sent to the manufacturer, the gaming operator can verify that certain information, such as coin-out/coin-in data is not being sent to a third-party, such as the manufacturer. In another embodiment, all data sent from the EGM 2 via mobile device can be first sent to an operator controlled device which can then forward the data device to a third-party, such as a gaming machine manufacturer or gaming machine component manufacturer.

When the EGM 2 establishes communications with mobile device 52, identification information can be received from the device that allows that mobile device to be recognized and possibly the device owner to be determined For example, the device 52 may have been registered with a player tracking program provided by a gaming establishment that operates EGM 2 (e.g., casino 100). In another example, the owner of mobile device 52 may have downloaded a gaming application that provides gaming related functions, such as the ability to transfer from the EGM 2 to a remote device. During the installation process or after installation of the application, the mobile device 52 can be registered. In one embodiment, the EGM 2 can be configured to only utilize recognized mobile devices to contact a remote device via a wide area connection provided by the mobile device.

Once a local connection is established between the EGM 2 and the mobile device 52, the EGM 2 can be configured to determine whether a connection with a remote device, such as server 56, can be established via a wide area network. In one embodiment, if an active communication session can't be established with a remote device, such as 56. The EGM 2 can be configured to download data to the mobile device 52 where the mobile device can be configured to send out the data at a later time when it establishes a connection with a wide area network. The transfer of the data from the mobile device to a remote server can occur after a user has left the vicinity of EGM 2, i.e., it can be out of communication range with EGM 2 when the data transfer occurs. In this embodiment, prior to sending data to the mobile device 52, the EGM 2 can be configured to check whether any data is stored on the mobile device 52 that is queued for transfer to a remote device, such as server 56. If the amount of data that is queued for transfer is above a certain amount, then the EGM 2 can be configured not to transfer any additional data to the mobile device for the purposes of placing it in the data queue. However, if an active communication session can be established with a remote device via the mobile device, the EGM 2 may still send data via the mobile device to the remote device.

As described above, different types of data can be stored in data store 50. For example, data related to a fault condition associated with the game controller or operational data related to gaming activity on the EGM 2 can be stored in 50. In one embodiment, if multiple data types are stored in 50, the EGM 2 can be configured to prioritize the different data types such that the most highly prioritized data is sent out first. For instance, data related to a recent fault condition might be sent out before operational data related to how much particular devices on the EGM 2 have been used. In another embodiment, the data can be sent out in the order it was placed in the data store 50, i.e., first-in/first out.

After it is determined that the mobile device 52 can be used to transfer data to a remote device, the EGM 2 can attempt to establish communications with a remote device, such as 56. When communications are established with the remote device, the EGM 2 can be configured to send a description of the data it wishes to send to server 56 and receive an acknowledgement from the device. In addition, the EGM 2 may send information about the mobile device and if available the mobile device owner. The server 56 can use this information to provide an incentive to the user for allowing their device to be used to transfer data. For instance, the incentive can be a cash reimbursement or a game play credit.

In one embodiment, the server 56 may locally store an incentive preference associated with a particular mobile device owner, such as an incentive selected during a registration process with server 56. In another embodiment, at the beginning of the communication, incentive information related to a preferred incentive for the user can be sent to the server 56. For instance, via an application executed on device 52 or server 56, incentive information can be selected by the user and stored to the mobile device 62. When the mobile device 52 contacts the remote server 56, the preferred incentive for the transaction can be sent to the server 56. Thus, a selected incentive can vary from transaction to transaction.

Next, the EGM 2 can select data from data store 50 that is to be transferred and format the data. The formatting of the data can include determining an amount of data to transfer and encrypting the data prior to transfer. In one embodiment, the amount that is sent during a particular transaction can be about 2 MB or less. For encryption purposes, the EGM 2 and the server 56 can be configured to exchange encryption data that allows data transferred between the two devices to be exchanged in a secure manner. The exchange of encryption data can occur after the EGM 2 has established communications with the server 56 via the mobile device 52 or via a previous communication not involving the mobile device. As described above, the EGM 2 can be configured to assess the connection provided by the mobile device, such as available bandwidth and the signal strength. The amount of data that is sent via each transfer can be varied based upon this information.

After the data is formatted for transfer, the data transfer can begin. As each portion of the data is received, the server 56 can be configured to send an acknowledgement to the EGM 2 that the data has been properly received. The server 56 can store the received data as incoming data 58. The EGM 2 can be configured to keep a log of the data it has attempted to transfer and whether it was successfully transferred or not. In one embodiment, the EGM 2 can be configured to only push data to the remote server and the amount of data it can receive from the server 56 will be very limited. For instance, the EGM 2 can be configured to only receive acknowledgements from the server 56 that the data has been successfully received and/or data that allow the EGM 2 to set up communications with the server 56.

In other embodiments, the EGM 2 can be configured to receive a download of information from the remote server 56. For instance, in one embodiment, the EGM 2 can be configured to receive from server 56 a download of new software/firmware that can be installed. For instance, new firmware for a bill validator on the EGM 2 can be received in this manner. In another example, the EGM 2 can be configured to receive a software patch that corrects an error condition on the EGM 2. In these instances, prior to accepting data from server 56, the EGM 2 can be configured to authenticate the server 56 as being a valid source for receiving data. Then, the EGM 2 can be configured to validate the received data.

After some amount of data is received at the server 56, the server 56 can be configured to generate a player incentive. The value of the incentive can depend on the amount of data that was transferred via the mobile device 52. In one embodiment, the server 56 can be configured to send a cash payment directly to the mobile device 52 as a reward for enabling the data transfer. In another embodiment, a credit redeemable for game play on the EGM 2 or another EGM can be sent to the mobile device 52. This credit may be immediately redeemable. For instance, if the EGM 2 is configured to receive ticket voucher information stored on a mobile device then a ticket voucher can be sent electronically to the mobile device that can be redeemed at the EGM.

In yet another embodiment, a coupon, such as a discount on a service or a discount at a restaurant, can be sent to the mobile device. The coupon may be valid for use in a venue associated with the gaming establishment where the EGM 2 is located. The EGM 2 or the mobile device can send information indicating the venue in which it is located. Based on this information, the server 56 can generate an incentive that is valid for use in the venue.

In additional embodiments, the server 56 can credit something value to an account provided by the player, such as a Paypal™ account or a player tracking account. For instance, an electronic transfer of cash can be made to a Paypal™ account while promotional credits or player tracking points can be electronically deposited into a player tracking account. In this example, the server 56 can send a message to the mobile device 52 indicating the transaction involving the transfer to the designated account has taken place. The message can include a description of the incentive, such as a number of player tracking points awarded for the data transfer transaction.

In one embodiment, the server 56 can be configured to credit only completed data transactions. For instance, if a connection is lost during a data transfer and the data has to be resent, the server 56 can be configured to provide incentives for the data successfully received but not the data that needed to be resent. In other embodiments, the server 56 can be configured to generate incentives based upon the amount of data that is received. Thus, if some data has to be resent because of a communication problem, the server will still credit the user for the use of the bandwidth on their mobile device.

With respect to FIG. 2B, a communication from an EGM 2 to a remote server via an operator controlled mobile device 64 is described. Like the player controlled mobile device 52, the operator controlled mobile device 64 can be utilized to couple the EGM 2 to a remote device, such as server 56. Since the device 64 is operator controlled, it is not necessary to provide incentives for making the mobile device available. In one embodiment, when the mobile device 64 is identified as being technician controlled, certain applications, such as diagnostic applications 66 executed on the server, can be made available for use on the mobile device 64. The diagnostic applications may allow a technician to diagnose a problem on the EGM 2 and/or provide information related to maintenance operations, such as a video clip showing how to remove and reinstall a particular device on the EGM.

In one embodiment, the EGM 2 can be configured to only communicate with a remote server via wide area network connection when it determines it is coupled to a technician controlled device. As a safeguard, the EGM 2 can be configured such that is must be placed in a special operator mode before the communication connection with the remote device 56 is allowed. In operator mode, when remote communications are enabled, game play is not enabled. In other embodiments, game play can be enabled while the EGM 2 is in communications with a remote device via a wide area network connection enabled by a mobile device as is shown in FIG. 2A.

To access the special operator mode, a technician may have to utilize a key or some other mechanism that allows the EGM to be placed in the operator mode. In addition, the communication interface that allows the EGM 2 to communicate with the mobile device 64 may only be activated when the device is placed in the operator mode. In one embodiment, the communication interface that allows communications with the mobile device 64 can be located in the interior of the EGM 2 such that it can only be used when access to the interior of the EGM cabinet is obtained. For security purposes, the EGM 2 can be configured to only communicate certain types of information when it is coupled to the remote server 56 via an operator controlled mobile device but not when it is coupled to the remote server 56 via a user controlled mobile device.

FIG. 2C is a block diagram showing the EGM 2 communicating with three mobile devices 52*a*, 52*b* and 52*c*. The EGM 2 can be configured to communicate with a number of mobile devices simultaneously. For instance, mobile device 52*b* can be associated with a number of individuals near the EGM 2, such as users engaging in game play on nearby EGMs or users standing near the EGM 2. When the EGM 2 is coupled to multiple devices simultaneously, the EGM 2 may split up a file in the data store 50 and send the pieces in parallel to a remote device, such as server 56. In another embodiment, one of the mobile devices, such as 52*a*, can be communicating with a mobile device where the communication application doesn't involve a wide area network connection but only a local communication between the EGM 2 and the mobile device 52*a*. In parallel, the EGM 2 can be communicating with a second mobile device, such as 52*b* or 52*c*, where a wide area communication connection has been established via the mobile device and data is being sent to server 56.

In another example, the EGM 2 can establish communications with the mobile devices 52*a*, 52*b* and 52*c*, in a serial manner where it is communicating with only 52*a* at a first time, only 52*b* at a second time and only 53*c* at a third time. Via the serial communications, the EGM 2 can be configured to transfer a portion of data set each time, such that multiple devices are used to complete the transfer of the data set. The amount of data and the length of connection time can vary from device to device.

In one embodiment, the EGM 2 can send a first data portion via first device, such as 52*a*, but not receive an indication from the remote server 56, that the transfer of the first data portion was successfully completed. Then, the EGM 2 can establish communications at a later time with a second mobile device, such as 52*b*, to server 56. If the server 56 sends an acknowledgement via the second mobile device that the first data portion was successfully delivered, then the EGM 2 can send a second data portion, such as a second portion of a data file. If an acknowledgement is not received from server 56, then the EGM 2 can resend the first portion to the server 56. In this way, delayed communications can be allowed where the EGM 2 transfers data to a mobile device when it is not providing an active connection to server 56. The data can be stored on a mobile device where the mobile device acts as a data cache. When the mobile device establishes a wide area network connection at a later time, data cached in the mobile device can be sent to the remote server. The communication transferring the data from the mobile device to the remote server can occur after the mobile device has left the vicinity of the EGM 2 that sent the data to the mobile device.

An example of an EGM communicating with multiple mobile devices including communicating with a remote server via a wide area network is discussed in more detail with respect to FIG. 3. FIG. 3 is an interaction diagram between an EGM 2, multiple mobile devices, 70 and 72 and a remote server 56 involving a transfer of data between the EGM 2 and the remote server 56. The transfer of data is enabled via a wide area network connection provided by the mobile devices.

The EGM 2 can detect a presence of mobile device 70. For example, the user may have swiped the device across a Near-Field Communication (NFC) interface on the EGM 2 (see FIGS. 8 and 9 for more details). In 102, a secure communication connection can be established between the EGM 2 and the mobile device 70, such as a secure Bluetooth™ pairing. In 104, the EGM 2 can determine whether a wide area network communication connection can be established using the mobile device 70. For instance, the EGM 2 may attempt to identify the mobile device or attempt to determine whether a particular application is executing on the mobile device 70. The fact that the particular application is being executed can be used to indicate that the user is willing to allow access to the wide area communications via the mobile device.

In 106, when the mobile device is determined to be usable for the purposes of establishing a wide area network connection, the EGM 2 can establish a wide area network connection via the mobile device. After the connection is established, the EGM 2 can attempt to communicate with the server 56. In one embodiment, a manufacturer of EGM 2 can maintain the server 56. Next, the EGM 2 can determine a set of data to send to the remote device. In 108, the EGM 2 can send a message to server 56 with a description of the data that the EGM 2 intends to push to manufacturer.

In 110, the server 56 can receive the message including the data description and save the description of data it now expects to receive from EGM 2. The server can send an acknowledgement message 112 to the EGM 2 indicating that it has received the description of the data. The data description may indicate data that the EGM 2 plans to send during the current communication session with server or data it plans to send over time.

For instance, the EGM 2 may indicate to the server it has a core dump to transfer. The EGM 2 can be configured to send information to the server about the about the core dump, such as a description of the core dump, when it occurred, what fault condition occurred that caused the core dump and the size of the core dump. The EGM can start sending the core dump data via mobile device 70 while the connection is available. It will send the transfer in finite portions as long as the connection is available. However, if the connection is lost then the EGM 2 may continue sending the remaining portion of the data via one or more mobile device connections it currently has available or come available in the future, such as a connection with mobile device 72. Knowing the overall size of the data that is going to be transferred, the server 56 can estimate how much data needs to be transferred before the transaction is complete.

The server 56 can be configured to communicate with a large number of EGMs that are deployed at various locations. Thus, the server 56 can include a database storing information about the EGMs, such as their model, manufacture data, software configuration, maintenance history, etc. The data description that is received in 110 can be stored to a record in the database associated with EGM 2.

In 114, the EGM 2 can be configured to determine a first data portion to send the remote server 56 via the mobile device. Depending on a size of a data file, it can be broken into multiple data portions. The size of the portion that is selected may depend on characteristics of the connection provided by the mobile device, such as its current speed. To estimate the speed, the EGM 2 can be configured to send test data to the server 56.

Based on the connection speed, the EGM 2 can be configured to estimate a length of the connection. For example, if a player associated with the mobile device has deposited $100 dollars as opposed $1 on the EGM 2, the EGM 2 may estimate the connection will last longer when more money has been deposited on the EGM 2. The speed of the connection and its estimated length can provide an approximation of how much data can be sent during the section. If multiple data sets are queued for transfer, the EGM 2 can be configured to select a smaller set over a larger set for transfer based upon the estimation of how much data can be transferred during the communications with the mobile device. Over time the characteristics of the connection can vary and the EGM 2 can be configured to adjust the transfer characteristics to account for changes to the connection, such as an increase or decrease in the connection speed. For instance, if the connection speed decreases, the EGM 2 may begin to send smaller data portions to increase the likelihood of the data portion being sent before a connection is lost.

Before the first portion of the data is sent, it can be encrypted. Thus, if data sent through the mobile device is intercepted, it may be difficult to determine the content of the intercepted data. In 116, the EGM 2 can send the first data portion to the server 56. The server 56 can receive the first data portion and save it in 118. In 112, the server 56 can send an acknowledgement that the first data portion was received. If the EGM 2 doesn't receive the acknowledgement within a certain time period, it may resend the data if a connection with the server is available. If it receives the acknowledgement, the EGM 2 can determine whether or not to send a second portion of the data. For instance, if the EGM 2 determines the connection is likely to end shortly, then the EGM 2 may wait before sending a second portion of the data.

In 120, the server 56 can save information associated with the data received from the mobile device. For instance, the server 56 can associate the data transfer transaction from the mobile device with a particular person so that the person can be rewarded for allowing their mobile device to be used. In addition, the server 56 might update a data log to indicate that some portion of data associated with a particular data set it is expecting to receive has been received.

In 122, the EGM 2 can determine a second portion of data, such as a second portion of a core dump, to send to the server 56. In 124, the EGM 2 can begin sending the second data portion. If the communication connection provided by the mobile device is interrupted while the second data portion is being sent, the EGM 2 can note that the data transfer was not completed. At a later time it can begin sending data starting from the point of the last acknowledged portion of data received. If the EGM 2 has completed sending the second portion of the data but the connection is lost before it has received an acknowledgement that the data has been received, in 130, the EGM 2 can note that the receipt of the second data portion has not been acknowledged.

On the server side, if the second portion is received completely, the server 56 can store the data and attempt to send an acknowledgement to the EGM 2. In 126, the server can save transaction information related to the second data portion. The transaction information might indicate that all or a fraction of the second data portion has been received. In one embodiment, a mobile device owner can be credited when partial data files are received even if the data transfer has to be repeated. In other embodiments, the server 56 can be configured to only credit a device owner for completed data transactions.

In 146, the server based upon the received data transfer transactions from mobile devices can generate the incentives and credit users associated with respective mobile devices. In some embodiments, the transactions can be credited immediately on a transaction by transaction basis. In other embodiments, the server 146 can be configured to determine the incentives on a periodic and device by device basis where the amount of the incentives can depend on an amount of transactions enabled by a particular mobile device that have occurred during a time period.

In 132, the EGM 2 can establish a secure communication, such as a secure wireless pairing, with a second mobile device, such as mobile device 72. In 134, the EGM 2 can determine whether device is available for a wide area network connection and if it is available, parameters associated with the connection, such as a connection speed. In 136, the EGM 2, via mobile device 72, can establish a communication connection with server 56. In one embodiment, when the communication session is established, the server can send an acknowledgement including the last data received. If the server 56 received the second portion of data in 124, then it can send an acknowledgement in this regard. In response, the EGM 2 can send a third portion of data that starts from the end of the second portion. If the server 56 indicates the last complete data it received was the first portion of data in 116, then the EGM 2 can resend the second portion of the data.

In 138, the EGM 2 can send the second portion of the data file. In one embodiment, the data file includes only two portions. Thus, in 140, the server 56 can receive the second portion, assemble the data file and save the assembled data file. The server 56 may send an acknowledgement to the EGM 2 indicating the second data portion has been received and the file has been successfully assembled. In 144, the server 56 can save transaction information regarding the data transfer enabled by mobile device 72 so that incentives can be provided to the mobile device owner.

Methods Related to Wide Area Network (WAN) Communications in a Gaming Environment Next details of methods involving wide area network connections on an EGM enabled via a mobile device connection are described with respect to FIGS. 4, 5, 6 and 7. In particular, two methods involving an EGM are described with respect to FIGS. 4 and 5. A method involving a remote server is described with respect to FIG. 6. Finally, a method involving a mobile device is described with respect to FIG. 7.

Figure 4:
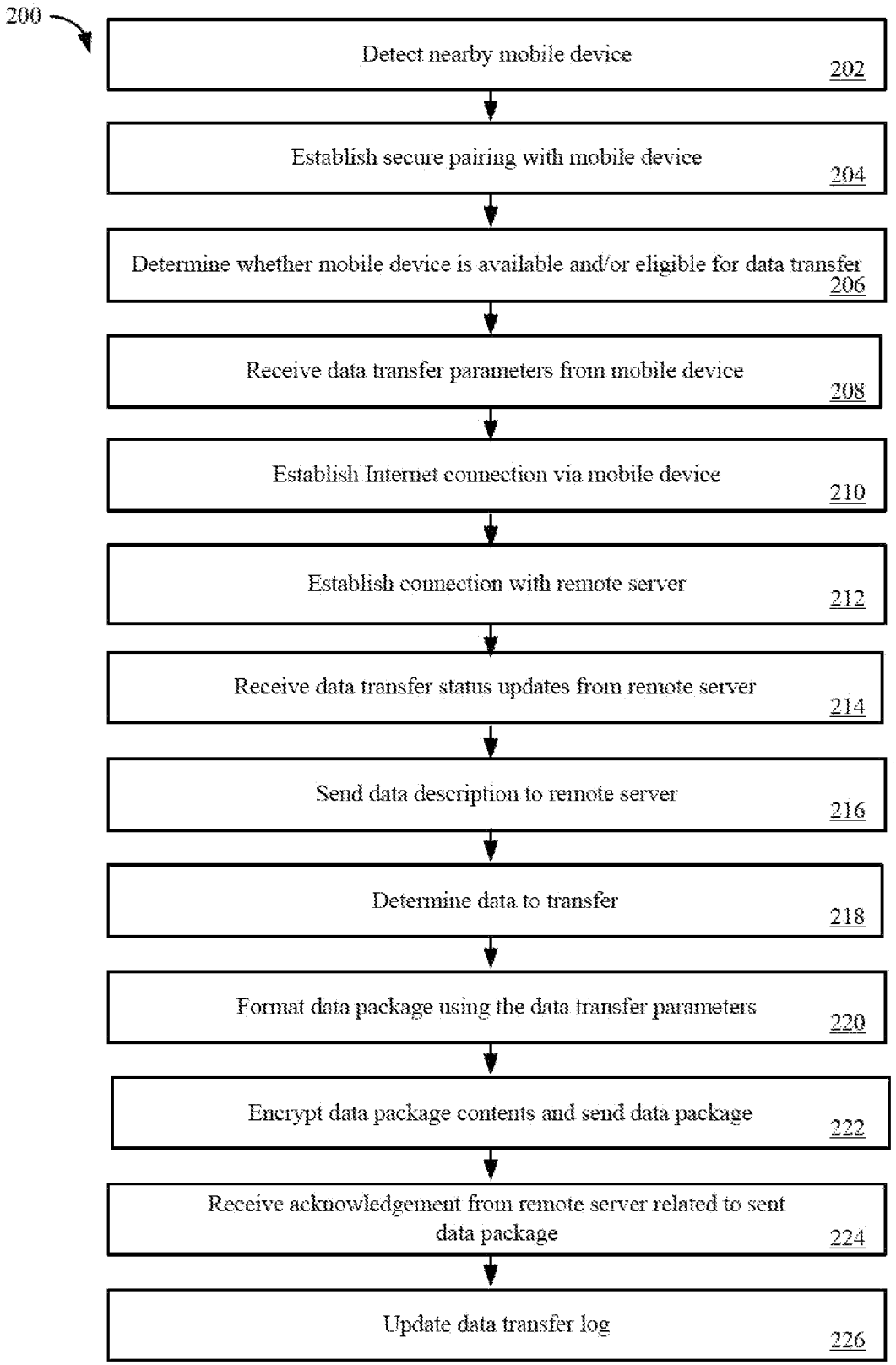
FIG. 4 is a method in a wager-based EGM for transferring data to a remote server via a mobile device in accordance with the described embodiments.

FIG. 4 is a method 200 of operating a wager-based EGM. In 202, the EGM can detect a nearby mobile device. For instance, the EGM can detect a wireless signal transmitted from the device or detect that the mobile device has been coupled to a wired connection on the EGM. In one embodiment, after a mobile device is detected, in 204, the EGM can establish a secure communication connection with the mobile device, such as a secure pairing.

In 206, the EGM can determine whether the mobile device is available and/or eligible for data transfers. For instance, the EGM may determine whether the mobile device is currently connected to a wide area network, such as the Internet. As another example, the EGM can determine that an application is currently executing on the mobile device that enables a data transfer between an EGM and a remote server. In yet another example, the EGM can receive data, such as mobile device identification data. Based upon this data, it can be determined whether the mobile device is a known mobile device and/or the owner of the mobile device is known. In some instances, data transfer using a mobile device may be limited to mobile devices and device owners that can be affirmatively identified by the EGM.

In 208, the EGM 2 can receive parameters related to data transfer capabilities on the mobile device, such as the type of the type and the speed of the connection. In 210, the EGM 2 can establish a wide area network connection, such as an Internet connection, via the mobile device. In 212, the EGM can establish a communication connection with a remote server via the wide area network connection. In one embodiment, if the remote sever is not available, the EGM may not attempt to send data to the remote server. In another embodiment, the EGM can download data to the mobile device where the mobile device can attempt to send the data at a later time when the server is available.

After the communication connection is established, in 214, if the EGM has begun a data transfer using another mobile device that has not been completed, the EGM may receive information from the remote device indicating the last portion of data that has been successfully received by the remote device. Based upon this information, the EGM can renew at the data transfer where it left off. In 216, the EGM can determine that a transfer of a new data set is to be initiated. In 216, the EGM can send a description of the data set that it intends to transfer to the remote server. In one embodiment, the data can include fault condition data, such as a core dump.

If the EGM is storing multiple data sets that are to be transferred to the remote serve, the EGM may determine an order in which to send the data sets.

In 218, the EGM can determine the data to transfer in a current transaction. For instance, the EGM may determine to send a 2-4 MB portion of a data file. The size of the data file that is sent can depend on the capabilities of the mobile device. In one embodiment, an application on the user mobile device may allow a user to select how much data can be sent at a time and a cap on the data that can be sent via the mobile device. For instance, the user can specify that a total of 100 MB can be sent via the mobile device over some time period. Each time a portion of data is sent via the mobile device, the amount remaining can be updated. When the amount remaining falls below a certain threshold, the EGM and subsequent EGMs that communicate with mobile device may no longer send data via the mobile device. If the cap is later increased, then EGM may again utilize the device for data transfers. The EGM can be configured to check cap data on the mobile device when it first establishes communications with the mobile device.

In 220, the EGM can format a data package according to the data transfer parameters it has determined, such as speed of the connection and a likely reliability of the connection. The likely reliability of the connection can be based upon a signal strength received at the mobile device. The speed of the connection can depend on the communication speed between the EGM and the mobile device and the communication speed of the mobile device with a wide area network. For instance, if the communication speed between the mobile device and the EGM is lower than the communication speed between the mobile device and the network then the communication speed between the mobile device and the EGM will limit the rate that data can be transferred.

The format of a data package may include a predicted size of the package based upon an encryption scheme that is to be utilized. In 222, the EGM can encrypt and send the data package contents. In some embodiments, the EGM 2 can utilize compression schemes to lower the size of the data package. In 224, the EGM can receive an acknowledgement that the data package has been received at the remote device from the remote device. In 226, the EGM can update a data transfer log indicating what data has been sent. If an acknowledgement is received of a successful data transfer, then the EGM can update a local data log with this information.

Figure 5:
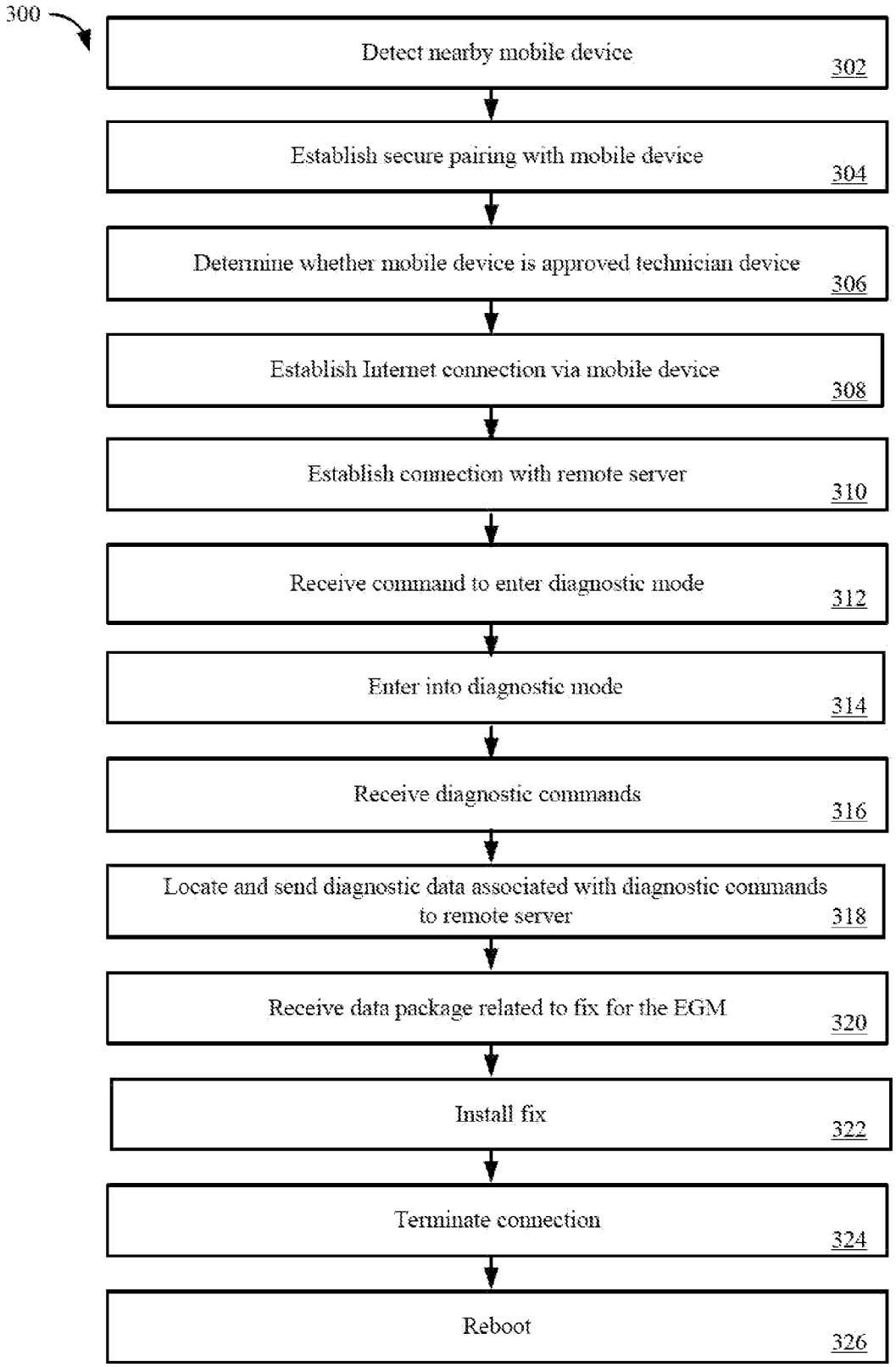
FIG. 5 is a method in a wager-based EGM for repairing and maintaining a wager-based EGM in accordance with the described embodiments.

FIG. 5 is a method 300 in a wager-based EGM for repairing and maintaining a mobile device. In 302, the EGM can detect a nearby mobile device. In one embodiment, this detection process may not be enabled unless the EGM is placed in a special operator mode. In 304, the EGM can establish a secure communication connection with the mobile device. In one embodiment, a secure communication interface can be located in an interior of EGM that is only accessible when the EGM cabinet has been opened. In addition, the secure communication interface may only be activated when the EGM is placed in the special operator mode with the cabinet open.

In 306, the EGM can receive information from the mobile device that allows it to verify whether the mobile device is an approved device, such as an approved technician device. If the device is approved, then in 308, the EGM can establish an Internet connection via the mobile device. Next, in 310, the EGM can establish a communication session with a remote device via the Internet connection, such as a server maintained by an EGM manufacturer.

In 312, the EGM can receive a command to enter into a special mode. The command can be received from the remote device or can be received via an input made at the EGM. In one embodiment, the special mode can be a diagnostic mode that allows fault conditions on the EGM to be analyzed. In another embodiment, the special mode can be a regulatory mode that allows software on the EGM to be authenticated. In the regulatory mode, the EGM can be configured to connect to a remote server provided by a regulatory agency, such as a game control board.

In 316, the EGM can receive diagnostic commands. In one embodiment, the diagnostic commands can be received from the remote device. For instance, a remote operator may attempt to diagnose a problem on the EGM via the connection established via the mobile device. In some embodiments, the diagnostic commands may request certain data available on the EGM. In 318, the EGM can locate and send requested diagnostic data to the remote server.

In 320, the EGM can receive a fix that solves a diagnosed problem. For instance, the fix can be an update of firmware for a peripheral device. In another example, the fix can be a software patch that fixes an error condition that has occurred on the EGM. In 322, the EGM can install the fix. In 324, the EGM can terminate its connection with the remote device and the mobile device. In 326, the EGM can install the fix. The installation may require the EGM to be rebooted. Finally, the EGM can enter into an operational mode where it is available for game play.

Figure 6:
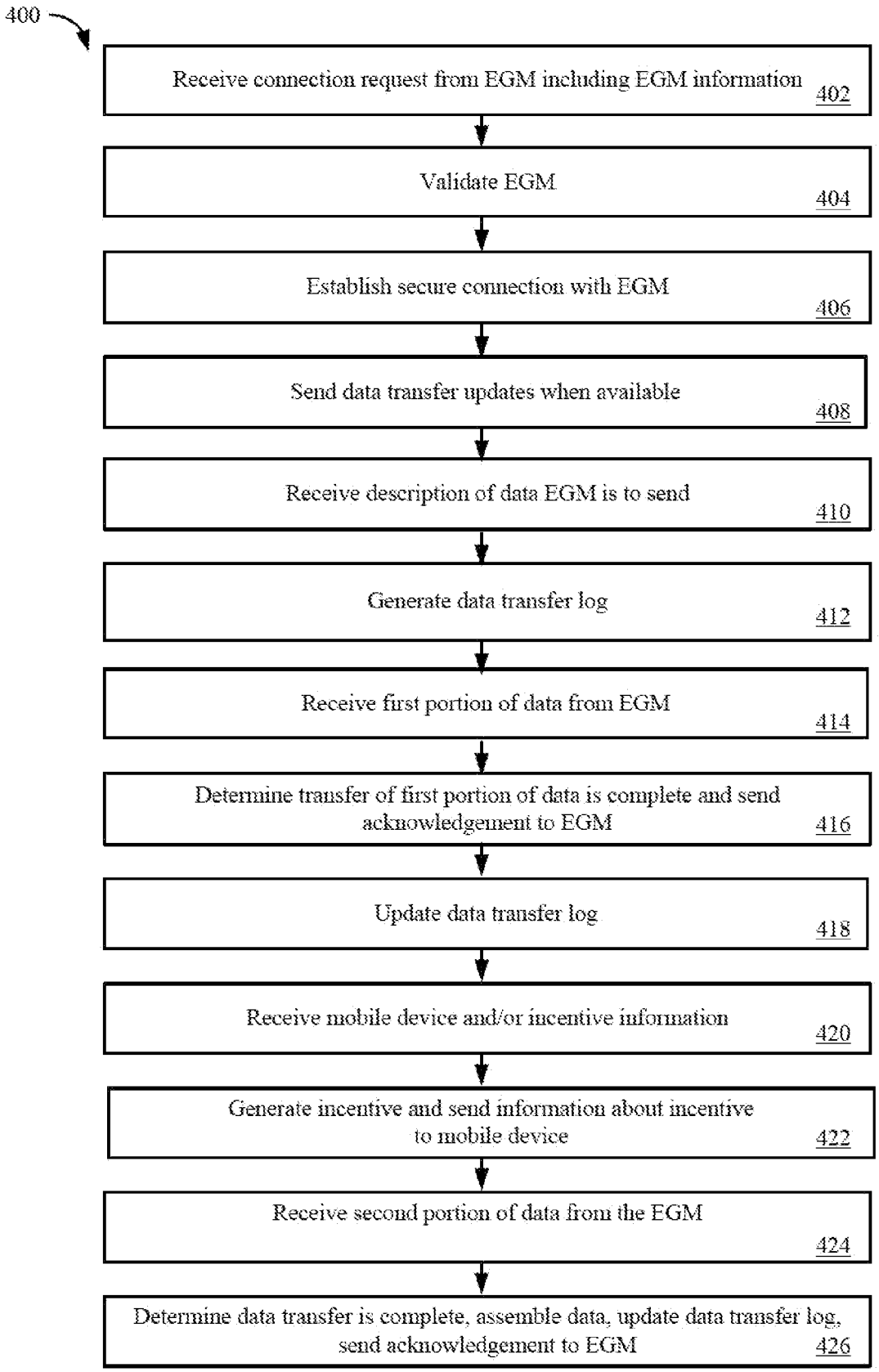
FIG. 6 is a method in a server of receiving data from an EGM in accordance with the described embodiments.

FIG. 6 is a method 400 in a server of receiving data from an EGM. In 402, the EGM can receive a connection request from an EGM via a wide area network connection, such as the Internet. The connection request can include EGM information that allows the server to identify the EGM. In one embodiment, the server can be maintained by an EGM manufacturer. The EGM information may allow the server to determine that the EGM was manufactured by the manufacturer maintaining the server. In 404, the server can validate the EGM based on the received information.

The server can also receive information about a mobile device that is being used to enable the communication connection with the EGM. The mobile device information may allow the server to send an award of some type to the mobile device or an account associated with an owner of the mobile device. The award can be for allowing the mobile device to be used to establish a wide area network connection.

In 406, the server can establish a secure communication connection with the EGM. The secure communication connection can involve encrypted data that is sent to the EGM and decrypting data that is received from the EGM. In 408, the server can send data transfer updates to the EGM. For instance, if the server has previously received data from the EGM, the server can send a message describing the last data that was successfully received and when it was received from the EGM.

In 410, the server can receive a description of data that the EGM intends to send to the server. The description can include a type of data, such as a core dump that occurred at a particular time, and a size of the data. Depending on a size of the data, it can be sent in one or more portions. In 412, the server can add the description of the data that it expects to receive to a data transfer log. When the data has been successfully transferred, the server can mark the data transfer as having been successfully completed. The server can have multiple data transfers open for a particular EGM at one time. For instance, the EGM can begin sending a data portion for a first data set. Before the first data set has been completely sent, the EGM can receive a second set of data with a higher priority than the first data set. In response, the EGM can send a description of the second data set to the remote server. When the second data set has been completely transferred to the remote server, the EGM can resume sending the first data set.

In 414, the server can receive a first portion of data from the EGM. The first portion can be associated with data described in the data description. In 416, the server can determine the transfer of the first portion of data is complete and send an acknowledgement to the EGM. In 418, the server can also save information about the successful data transfer to a data transfer log. Information about the last successful data transfer can be sent to the EGM during a subsequent communication that occurs after the current communication has ended.

In 420, the server can receive mobile device and/or incentive information. The mobile device information may allow the server to locate information about the mobile device owner so that an incentive can generated for the owner. The EGM can be configured to send an awarded incentive or information about the awarded incentive to a particular mobile device or an account accessible from the mobile device, such as e-mail account. The incentive information can specify a type of incentive to generate. For instance, it can indicate that the incentive is to be generated as a cash award, game play credits, player tracking points or promotional coupons.

In 422, after a data transfer enabled via the mobile device, the server can be configured to generate an incentive that has been earned as a result of the data transfer and send information about the incentive to the mobile device. For instance, an electronic voucher instantly redeemable for game play can be sent to the mobile device. In another example, information about a transfer of funds to a mobile device owner account can be sent to the mobile device.

In 424, the server can receive a second portion of data associated with a data file from the EGM. In 426, the server can determine that the data transfer of the second portion is complete. Then, the server can determine that a data transfer of a data set including the first and second portion has been completed. When all of the portions of a data set have been received then the data set, which may be a data file, can be assembled. Next, the data transfer log can be updated and an acknowledgement can be sent to the EGM.

Figure 7:
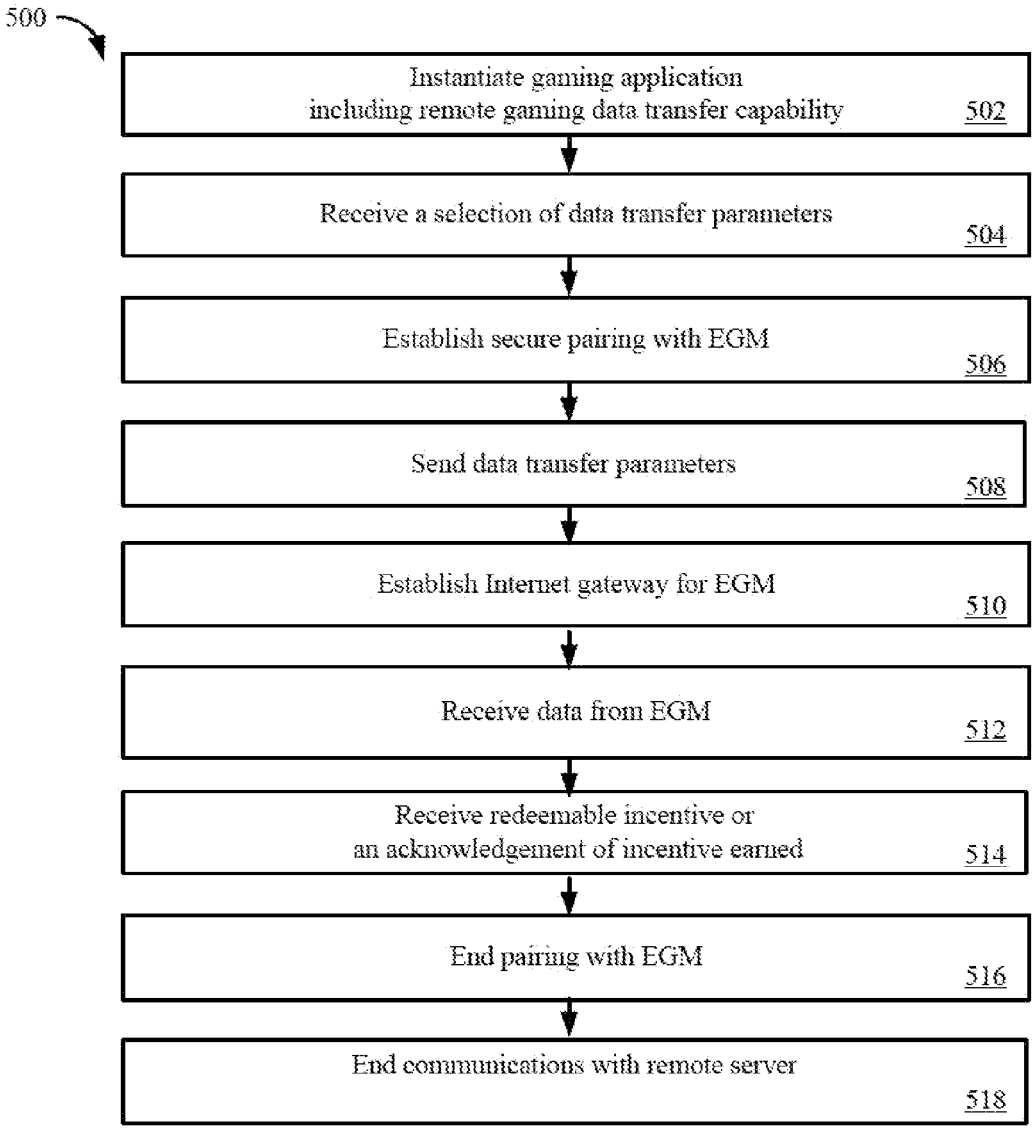
FIG. 7 is a method in a mobile device for facilitating a data transfer between a wager-based EGM and a remote server in accordance with the preferred embodiments.

FIG. 7 is a method 500 in a mobile device for facilitating a data transfer between a wager-based EGM and a remote server. In one embodiment, in 502, a gaming application including a remote gaming data transfer capability can be instantiated on the mobile device. In some instances, this application may need to be executing on the mobile device before the EGM will attempt to initiate a data transfer using the mobile device.

In 504, a set of data transfer parameters can be received. For instance, a selection of data transfer parameters can be made via an interface, such as a touch screen interface on the mobile device. The data transfer parameters can include settings, such as a total amount of data that can be transferred over a time period, an amount of data that can be transferred during a single communication session, an amount of network bandwidth that can be allocated to the data transfer and preferred incentives for allowing their mobile device to be used for the data transfer.

In 506, the mobile device can establish a secure communication connection with an EGM, such as a secure wireless pairing with an EGM located in a casino. In 508, the mobile device can send parameters that affect a data transfer to the EGM. The parameters can include information about its current capabilities, such as its networking capabilities, current connection strength, etc., and data transfer parameters that may have been selected by a user, such as data caps. The mobile device may also send information that allows a mobile device owner to be identified and/or the mobile device to be identified. As described above, the EGM may be configured to only attempt to use particular mobile devices for the purposes of wide area network communication.

In 510, the mobile device can be used to establish a wide area network connection, such as an Internet connection. In 512, the mobile device can receive data from the EGM that is routed to the server via the mobile device's wide area network connection. In 514, the mobile device can receive a redeemable incentive, such as instantly redeemable game play credits, or an acknowledgement from the server that an incentive has been earned.

In 516, the secure communication connection with the EGM can be ended. In one embodiment, communications with the server can continue after the pairing ends. For instance, the mobile device can complete the transfer of a data portion that it has received from the EGM that was sent prior to the termination of the secure communication connection with the EGM. In 518, communications with the remote server can be ended. In some instances, when the secure communication connection is terminated with the EGM, the communications with the remote server may also be ended.

Gaming System and EGMs

Figure 8:
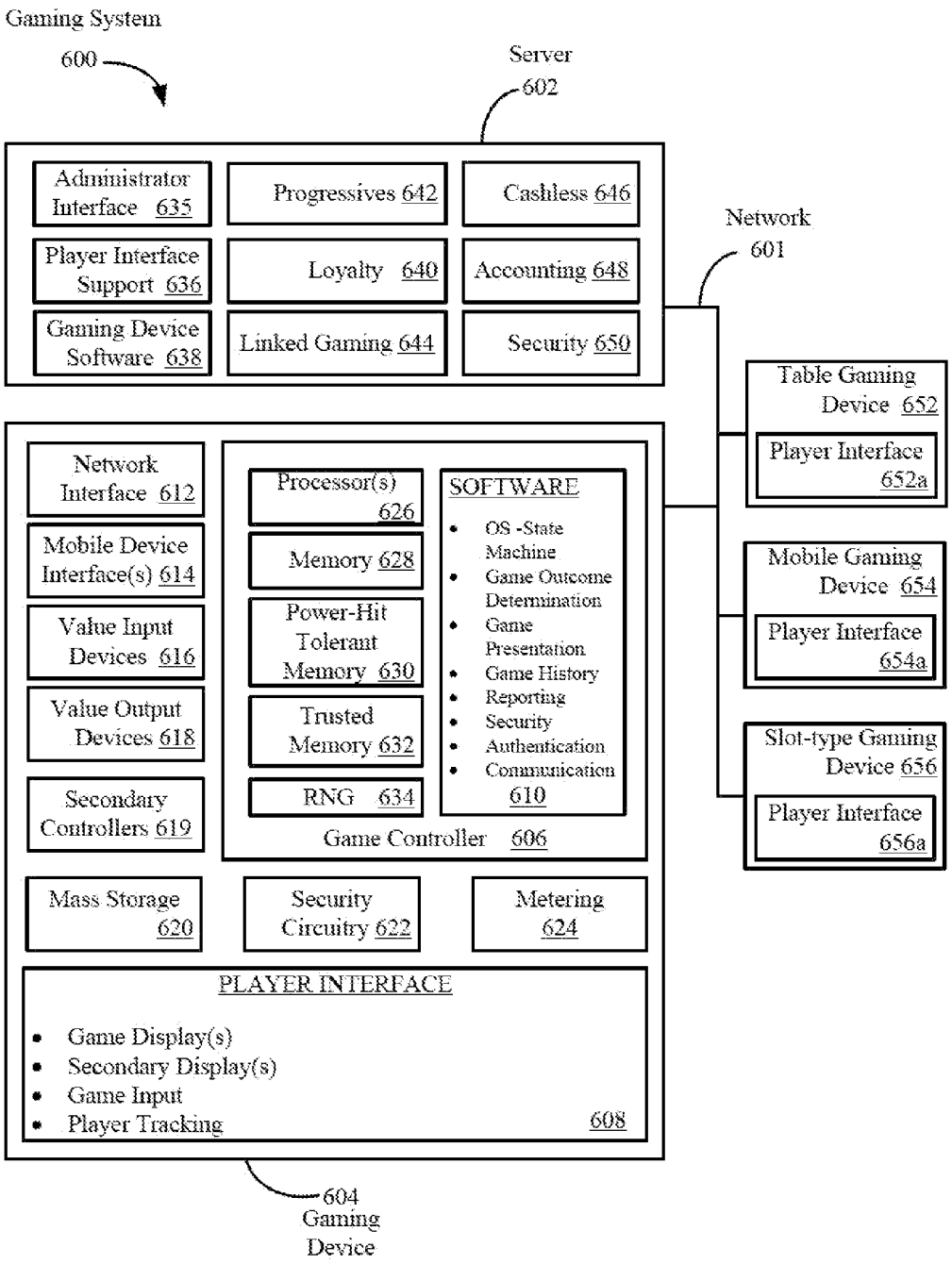
FIG. 8 shows a block diagram of a gaming device in accordance with the described embodiments.
Figure 9:
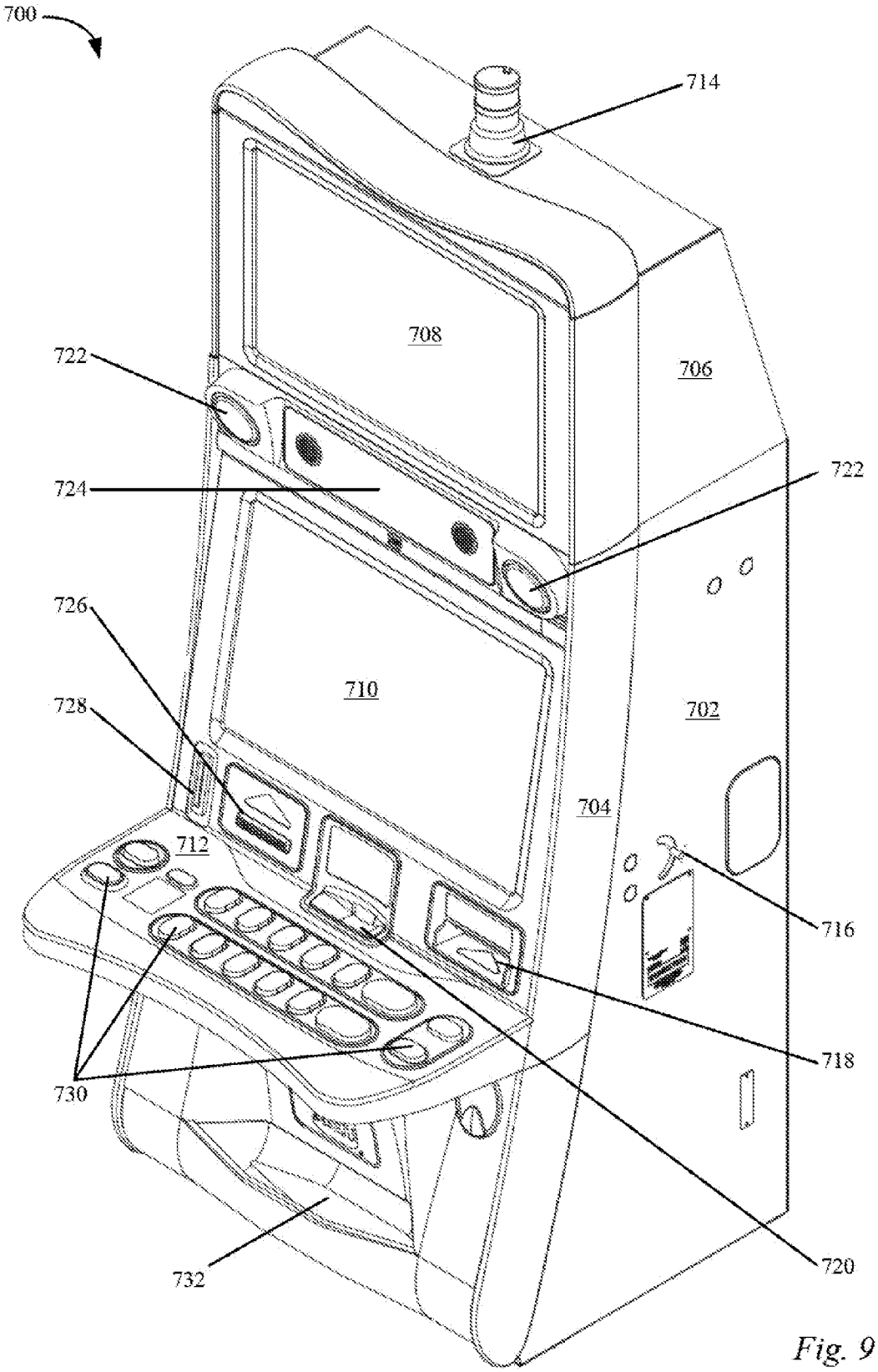
FIG. 9 shows a perspective drawing of a gaming device in accordance with the described embodiments.

Next additional details of EGMs and gaming systems are described with respect to FIGS. 8 and 9. Communications between a mobile device and an EGM can be enabled by one or more the devices described with respect to FIGS. 8 and 9. In particular, as described above, the communications can be used to display on the EGM a copy of a mobile device screen display. In addition, the gaming system can be configured to allow remote control of a mobile device via inputs received at the EGM. For instance, an application on the mobile device can be launched or affected by inputs received at the EGM and sent to the mobile device.

FIG. 8 shows a block diagram of a gaming system 600 in accordance with the described embodiments. The gaming system 600 can include one or more servers, such as server 602, and a variety of gaming devices including but not limited to table gaming devices, such as 652, mobile gaming devices, such as 654, and slot-type gaming devices, such as 656. The table gaming devices, such as 652, can include apparatus associated with table games where a live operator or a virtual operator is employed. The gaming devices and one or more servers can communicate with one another via a network 601. The network can include wired, wireless or a combination of wired and wireless communication connections and associated communication routers.

Some gaming devices, such as 652, 654 and 656, can be configured with a player interface that allows at least 1) selections, such as a wager amount, associated with a wager-based game to be made and 2) an outcome of the wager-based game to be displayed. As an example, gaming devices, 652, 654 and 656, include player interfaces, 652*a*, 654*a* and 656*a*, respectively. Typically, gaming devices with a player interface are located in publically accessible areas, such as a casino floor. On the other hand, some gaming devices, such as server 602, can be located in publically inaccessible areas, such is in a back-room of a casino or even off-site from the casino. Gaming devices located in publically inaccessible areas may not include a player interface. For instance, server 602 does not include a player interface. However, server 602 includes an administrator interface 635 that allows functions associated with the server 602 to be adjusted.

An example configuration of a gaming device is described with respect to gaming device 604. The gaming device 604 can include 1) a game controller 606 for controlling a wager-based game played on the gaming device and 2) a player interface 608 for receiving inputs associated with the wager-based game and for displaying an outcome to the wager-based game. In more detail, the game controller 606 can include a) one or more processors, such as 626, b) memory for holding software executed by the one or more processors, such as 628, c) a power-hit tolerant memory, such as 630, d) one or more trusted memories, such as 632, e) a random number generator and f) a plurality of software applications, 610. The other gaming devices, including table gaming device 652, mobile gaming device 654, slot-type gaming device 656 and server 602, can each include a game controller with all or a portion of the components described with respect to game controller 606.

In particular embodiments, the gaming device can utilize a "state" machine architecture. In a "state" machine architecture critical information in each state is identified and queued for storage to a persistent memory. The architecture doesn't advance to the next state from a current state until all the critical information that is queued for storage for the current state is stored to the persistent memory. Thus, if an error condition occurs between two states, such as a power failure, the gaming device implementing the state machine can likely be restored to its last state prior to the occurrence of the error condition using the critical information associated with its last state stored in the persistent memory. This feature is often called a "roll back" of the gaming device. Examples of critical information can include but are not limited to an outcome determined for a wager-based game, a wager amount made on the wager-based game, an award amount associated with the outcome, credits available on the gaming device and a deposit of credits to the gaming device.

The power-hit tolerant memory 630 can be used as a persistent memory for critical data, such as critical data associated with maintaining a "state" machine on the gaming device. One characteristic of a power-hit tolerant memory 630 is a fast data transfer time. Thus, in the event of a power-failure, which might be indicated by a sudden power fluctuation, the critical data can be quickly loaded from volatile memory, such as RAM associated with the processor 626, into the power-hit tolerant memory 630 and saved.

In one embodiment, the gaming device 605 can be configured to detect power fluctuations and in response, trigger a transfer of critical data from RAM to the power-hit tolerant memory 630. One example of a power-hit tolerant memory 630 is a battery-backed RAM. The battery supplies power to the normally volatile RAM so that in the event of a power failure data is not lost. Thus, a battery-backed RAM is also often referred to as a non-volatile RAM or NV-RAM. An advantage of a battery-backed RAM is that the fast data transfer times associated with a volatile RAM can be obtained.

The trusted memory 632 is typically a read-only memory of some type that may be designed to be unalterable. An EPROM or EEPROM are two types of memory that can be used as a trusted memory 632. The gaming device 604 can include one or more trusted memories. Other types of memories, such as Flash memory, can also be utilized as an unalterable memory and the example of an EPROM or EEPROM is provided for purposes of illustration only.

Prior to installation the contents of a trusted memory, such as 632, can be verified. For instance, a unique identifier, such as a hash value, can be generated on the contents of the memory and then compared to an accepted hash value for the contents of the memory. The memory may not be installed if the generated and accepted hash values do not match. After installation, the gaming device can be configured to check the contents of the trusted memory. For instance, a unique identifier, such as a hash value, can be generated on contents of the trusted memory and compared to an expected value for the unique identifier. If the generated value of the unique identifier and the expected value of the unique identifier don't match, then an error condition can be generated on the gaming device 604. In one embodiment, the error condition can result in the gaming device entering a tilt state where game play is temporarily disabled on the gaming device.

Sometimes verification of software executed on the gaming device 604 can be performed by a regulatory body, such as a government agency. Often software used by a game controller, such as 606, can be highly regulated, where only software approved by a regulatory body is allowed to be executed by the game controller 606. In one embodiment, the trusted memory 632 can store authentication programs and/or authentication data for authenticating the contents of various memories on the gaming device 604. For instance, the trusted memory 632 can store an authentication program that can be used to verify the contents of a mass storage device, such as 620, which can include software executed by the game controller 606.

The random number generator (RNG) 634 can be used to generate random numbers that can be used to determine outcomes for a game of chance played on the gaming device. For instance, for a mechanical or video slot reel type of game, the RNG, in conjunction with a paytable that lists the possible outcomes for a game of chance and the associated awards for each outcome, can be used to generate random numbers for determining reel positions that display the randomly determined outcomes to the wager-based game. In other example, the RNG might be used to randomly select cards for a card game. Typically, as described above, the outcomes generated on a gaming device, such as 604, are considered critical data. Thus, generated outcomes can be stored to the power-hit tolerant memory 630.

Not all gaming devices may be configured to generate their own game outcomes and thus, may not use an RNG for this purpose. In some embodiments, game outcomes can be generated on a remote device, such as server 602, and then transmitted to the gaming device 604 where the outcome and an associated award can be displayed to the player via the player interface 608. For instance, outcomes to a slot-type game or a card game can be generated on server 602 and transmitted to the gaming device 604.

In other embodiments, the gaming device 604 can be used to play central determination games, such as bingo and lottery games. In a central determination game, a pool of game outcomes can be generated and then, particular game outcomes can be selected as needed (e.g., in response to a player requesting to play the central determination game) from the pool of previously generated outcomes. For instance, a pool of game outcomes for a central determination game can be generated and stored on server 602. Next, in response to a request to play the central determination game on gaming device 604, one of the outcomes from the pool can be downloaded to the gaming device 604. A game presentation including the downloaded outcome can be displayed on the gaming device 604.

In other embodiments, thin client type gaming devices, such as mobile gaming devices used to play wager-based video card or video slot games, may be configured to receive at least game outcomes from a remote device and not use an RNG to generate game outcomes locally. The game outcomes can be generated remotely in response to inputs made on the mobile device, such as an input indicating a wager amount and/or an input to initiate the game. This information can be sent from the mobile device to a remote device, such as from mobile gaming device 654 to server 602. After receiving the game outcome from the remote device, a game presentation for the game outcomes generated remotely can be generated and displayed on the mobile device. In some instances, the game presentation can also be generated remotely and then streamed for display to the mobile device.

The game controller 606 can be configured to utilize and execute many different types of software applications 610. Typically, the software applications utilized by the game controller 606 can be highly regulated and may undergo a lengthy approval process before a regulatory body allows the software applications to be utilized on a gaming device deployed in the field, such as in a casino. One type of software application the game controller can utilize is an Operating System (OS). The OS can allow various programs to be loaded for execution by the processor 626, such as programs for implementing a state machine on the gaming device 606. Further, the OS can be used to monitor resource utilization on the gaming device 606. For instance, certain applications, such as applications associated with game outcome generation and game presentation that are executed by the OS can be given higher priority to resources, such as the processor 626 and memory 628, than other applications that can be executing simultaneously on the gaming device.

As previously described, the gaming device 604 can execute software for determining the outcome of a wager-based game and generating a presentation of the determined game outcome including displaying an award for the game. As part of the game outcome presentation one or more of 1) electro-mechanical devices, such as reels or wheels, can be actuated, 2) video content can be output to video displays, 3) sounds can be output to audio devices, 4) haptic responses can be actuated on haptic devices or 5) combinations thereof, can be generated under control of the game controller 606. The peripheral devices used to generate components of the game outcome presentation can be associated with the player interface 608 where the types of devices that are utilized for the player interface 608 can vary from device to device.

To play a game, various inputs can be required. For instance, via input devices coupled to the gaming device 604, a wager amount can be specified, a game can be initiated or a selection of a game choice associated with the play of the game can be made. The software 610 executed by the game controller 606 can be configured to interpret various signals from the input devices, such as signals received from a touch screen controller or input buttons, and affect the game played on the gaming device in accordance with the received input signals. The input devices can also be part of the player interface 608 provided with the gaming device, such as 604.

In other embodiments, the gaming software 610 executed by the game controller 606 can include applications that allow a game history including the results of a number of past games to be stored, such as the previous 10 or 100 games played on the gaming device 604. The game history can be stored to a persistent memory including but not limited to the power-hit tolerant memory 630. The gaming controller 606 can configured to provide a menu (typically, only operator accessible), that allows the results of a past game to be displayed via the player interface 608. The output from the history menu can include a re-creation of the game presentation associated with a past game outcome, such as a video representation of card hand associated with a video poker game, a video representation of a reel configuration associated with a video slot game, and/or raw data associated with the past game result, such as an award amount, an amount wagered, etc. The history menu can be used for dispute resolution purposes, such as if a player complains that they have not been properly awarded for a game previously played on the gaming device 604.

The reporting software can be used by the game controller 606 to report events that have occurred on the gaming device 604 to remote device, such as server 602. For instance, in one embodiment, the game controller 606 can be configured to report error conditions that have been detected on the gaming device 604, such as if a device has malfunctioned or needs attention. For instance, the reporting software can be used to send a message from the gaming device 604 to the server 602 indicating that a printer on the gaming device needs a refill of tickets. In another embodiment, the gaming controller 606 can be configured to report security events that may have occurred on the gaming device 604, such as but not limited to if a door is opened, a latch is activated or an interior portion of the gaming device 604 has been accessed.

In yet other embodiments, the game controller 606 can be configured to report gaming activity and associated events that has been generated on the gaming device, such as a deposit of cash or an indicia of credit, at the gaming device, a generation of game outcome including an associated award amount and a dispensation of cash or an indicia of credit from the gaming device 604. As part of a loyalty program, the gaming activity can be associated with a particular player. The reporting software can include player tracking elements that allow the gaming activity of a particular player to be reported to a remote device, such as server 602.

The game controller 606 can execute the authentication software to verify the authenticity of data and/or software programs executed on the gaming device 604. For instance, the authentication software can be used to verify the authenticity of data and/or software applications when they are first downloaded to the gaming device 604. Further, the authentication software can be used to periodically verify the authenticity of data and/or software applications currently residing on the gaming device, such as software applications stored on one of the memories coupled to the gaming device 604 including applications loaded into the memory 628 for execution by the processor 626.

The communication software executed by the game controller 606 can be used to communicate with a variety of devices remote to the gaming device 604. For instance, the communication software can be used to communicate with one or more of a) servers remote to the device, such as 602, b) other gaming devices, such as table gaming device 652, mobile gaming device 654 and slot-type gaming device 656 and c) mobile devices carried by casino personnel or players in the vicinity of the gaming device 604. Via the communication software, the game controller can be configured to communicate via many different communication protocols. For instance, different wireless and/or wired communication protocols can be implemented. Further, proprietary or non-proprietary gaming specific protocols can be implemented. For instance, gaming specific non-proprietary communication protocols, such as G2S (game to system), GDS (gaming device standard) and S2S (system to system) communication protocols provided by the Gaming Standards Association (GSA), Fremont, Calif., can be implemented on the gaming devices described herein.

The gaming device 604 can communicate with one or more remote devices via one or more network interfaces, such as 612. For instance, via network interfaces 612 and the network 601, the gaming device 604 can communicate with other gaming devices, such as server 602 and/or gaming devices, 652, 654 and 656. The network interfaces can provide wired or wireless communications pathways for the gaming device 604. Some gaming devices may not include a network interface or can be configured to operate in a stand-alone mode where the network interface is not connected to a network.

In other embodiments, a mobile device interface or interfaces, such as 614, can be provided for communicating with a mobile device, such as a cell phone or a tablet computer carried by players or casino personnel temporarily in the vicinity of the gaming device 604. A wireless communication protocol, such as Bluetooth™ and a Wi-Fi compatible standard, can be used for communicating with the mobile devices via the mobile device interfaces 614. In one embodiment, the mobile device interface can implement a short range communication protocol, such as a near-field communication (NFC) protocol used for mobile wallet applications. NFC is typically used for communication distances of 4 cm or less. In addition, a wired communication interface, such as a docking station, can be integrated into the gaming device, such as 604. The wired communication interface can be configured to provide communications between the gaming device 604 and the mobile device and/or providing power to the mobile device.

Near field communication, or NFC, allows for simplified transactions, data exchange, and connections with a touch. Formed in 2004, the Near Field Communication Forum (NFC Forum) promotes sharing, pairing, and transactions between NFC devices and develops and certifies device compliance with NFC standards. NFC's short range helps keep encrypted identity documents private. Thus, a smartphone or tablet with an NFC chip can make a credit card/debit card payment to a gaming device or serve as keycard or ID card for a loyalty program. Further, an NFC device can act a hotel room key. The user of an NFC device as a hotel room keys and/or a player tracking card instrument may allow fast VIP check-in and reduce staffing requirements.

NFC devices can read NFC tags on a gaming device 604 to get more information about the gaming device including an audio or video presentation. For instance, a tap of an NFC enabled device to a gaming device can be used to instantly share a contact, photo, song, application, video, or website link In another example, an NFC enabled device can be used to transfer funds to the gaming device or enter the player in a multi-player tournament. As another example, an NFC enabled device can be used to receive information from a gaming device that can be used in a persistent gaming application or a social media application.

Further, NFC enabled signage can include NFC tags that allow a patron to learn more information about the content advertised in the signage. The NFC enabled signage can be part of a gaming system. For instance, a sign advertising a show available at the casino can be configured to transfer information about the show, show times and ticketing information via an NFC tag. As another example, a sign showing jackpot information, such as progressive jackpot information, can be used to transfer information about the jackpot, such as the last time the jackpot was won and where it was won.

In one embodiment, an NFC interface on a gaming device can be used to set-up a higher speed communication between the gaming device and another NFC enabled device such as smart phone. The higher speed communication rates can be used for expanded content sharing. For instance, a NFC and Bluetooth enabled gaming device can be tapped by an NFC and Bluetooth enabled smart phone for instant Bluetooth pairing between the devices. Instant Bluetooth pairing between a gaming device and an NFC enabled device, such as a smartphone, can save searching, waiting, and entering codes. In another example, a gaming device can be configured as an NFC enabled router, such as a router supporting a Wi-Fi communication standard. Tapping an NFC enabled device to an NFC enabled and Wi-Fi enabled gaming device can be used to establish a Wi-Fi connection between the two devices.

For instance, Bluetooth™ pairing occurs when two Bluetooth devices agree to communicate with each other and establish a connection. In order to pair two Bluetooth wireless devices, a password (passkey) is exchanged between the two devices. The Passkey is a code shared by both Bluetooth devices, which proves that both users have agreed to pair with each other. After the passkey code is exchanged, an encrypted communication can be set up between the pair devices. In Wi-Fi paring, every pairing can be set up with WPA2 encryption or another type of encryption scheme to keep the transfer private. Wi-Fi Direct is an example of a protocol that can be used to establish point-to-point communications between two Wi-Fi devices. The protocol allows for a Wi-Fi device pair directly with another without having to first join a local network. The method makes it possible to share media from a phone, play multiplayer games or otherwise communicate directly, even when no router exists. Via pairing between a gaming device 604 and a mobile device 654, a mobile device 654 may be able to utilize some of the functionality of secondary devices residing on the gaming device 604. For instance, when a mobile device 654 is paired to a gaming device 604, it may be possible for a player to print something from their mobile device 654 using a printer on the gaming device 604.

The gaming device 604 can include one or more each of value input devices 616 and value output device 618. The value input devices 616 can be used to deposit cash or indicia of credit onto the gaming device. The cash or indicia of credit can be used to make wagers on games played on the gaming device 604. Examples of value input devices 616 include but are not limited to a magnetic-striped card or smart card reader, a bill and/or ticket acceptor, a network interface for downloading credits from a remote source, a wireless communication interface for reading credit data from nearby devices and a coin acceptor. A few examples of value input devices are shown in FIG. 9.

The value output devices can be used to dispense cash or indicia of credit from the gaming device 604. Typically, the indicia of credit can be exchanged for cash. For instance, the indicia of credit can be exchanged at a cashier station or at a redemption station. Examples of value output devices can include a network interface for transferring credits into a remote account, a wireless communication interface that can be used with a mobile device implementing mobile wallet application, a coin hopper for dispensing coins or tokens, a bill dispenser, a card writer, a printer for printing tickets or cards redeemable for cash or credits. Another type of value output device is a merchandise dispenser, which can be configured to dispense merchandise with a tangible value from a gaming device. A few examples of value output devices are shown in FIG. 9.

The combination of value input devices 616 and value output devices 618 can vary from device to device. In some embodiments, a gaming device 604 may not include a value input device or a value output device. For instance, a thin-client gaming device used in a mobile gaming application may not include a value input device and a value output device. Instead, a remote account can be used to maintain the credits won or lost from playing wager-based games via the mobile device. The mobile device can be used to access the account and affect the account balance via game play initiated on the mobile device. Credits can be deposited or withdrawn from the remote account via some mechanism other than via the mobile device interface.

In yet other embodiments, the gaming device 604 can include one or more secondary controllers 619. The secondary controllers can be associated with various peripheral devices coupled to the gaming device, such as the value input devices and value output devices described in the preceding paragraphs. As another example, the secondary controllers can be associated with peripheral devices associated with the player interface 608, such as input devices, video displays, electro-mechanical displays and a player tracking unit. In some embodiments, the secondary controllers can receives instructions and/or data from and provide responses to the game controller 606. The secondary controller can be configured to interpret the instructions and/or data from the game controller 606 and control a particular device according to the received instructions and/or data. For instance, a print controller may receive a print command with a number of parameters, such as a credit amount and in response print a ticket redeemable for the credit amount. In another example, a touch screen controller can detect touch inputs and send information to the game controller 606 characterizing the touch input.

In a particular embodiment, a secondary controller can be used to control a number of peripheral devices independently of the game controller 606. For instance, a player tracking unit can include one or more of a video display, a touch screen, card reader, network interface or input buttons. A player tracking controller can control these devices to provide player tracking services and bonusing on the gaming device 604. In alternate embodiments, the game controller 604 can control these devices to perform player tracking functions. An advantage of performing player tracking functions via a secondary controller, such as a player tracking controller, is that since the player tracking functions don't involve controlling the wager-based game, the software on the player tracking unit can be developed modified via a less lengthy and regulatory intensive process than is required for software executed by the game controller 606, which does control the wager-based game. In general, using a secondary controller, certain functions of the gaming device 604 that are not subject to as much regulatory scrutiny as the game play functions can be decoupled from the game controller 606 and implemented on the secondary controller instead. An advantage of this approach, like for the player tracking controller, is that software approval process for the software executed by the secondary controller can be less intensive than the process needed to get software approved for the game controller.

A mass storage unit(s) 620, such as a device including a hard drive, optical disk drive, flash memory or some other memory storage technology can be used to store applications and data used and/or generated by the gaming device 604. For instance, a mass storage unit, such as 620, can be used to store gaming applications executed by the game controller 606 where the gaming device 604 can be configured to receive downloads of game applications from remote devices, such as server 602. In one embodiment, the game controller 606 can include its own dedicated mass storage unit. In another embodiment, critical data, such as game history data stored in the power-hit tolerant memory 630 can be moved from the power-hit tolerant memory 630 to the mass storage unit 620 at periodic intervals for archival purposes and to free up space in the power-hit tolerant memory 630.

The gaming device 604 can include security circuitry 622, such as security sensors and circuitry for monitoring the sensors. The security circuitry 622 can be configured to operate while the gaming device is receiving direct power and operational to provide game play as well as when the gaming device is uncoupled from direct power, such as during shipping or in the event of a power failure. The gaming device 604 can be equipped with one or more secure enclosures, which can include locks for limiting access to the enclosures. One or more sensors can be located within the secure enclosures or coupled to the locks. The sensors can be configured to generate signals that can be used to determine whether secure enclosures have been accessed, locks have been actuated or the gaming device 604, such as a mobile device has been moved to an unauthorized area. The security monitoring circuitry can be configured to generate, store and/or transmit error events when the security events, such as accessing the interior of the gaming device, have occurred. The error events may cause the game controller 606 to place itself in a "safe" mode where no game play is allowed until the error event is cleared.

The server 602 can be configured to provide one or more functions to gaming devices or other servers in a gaming system 600. The server 602 is shown performing a number of different functions. However, in various embodiments, the functions can be divided among multiple servers where each server can communicate with a different combination of gaming devices. For instance, player interface support 636 and gaming device software 638 can be provided on a first server, progressives can be provided on a second server, loyalty program functions 640 and accounting 648 can be provided on a third server, linked gaming 644 can be provided on a fourth server, cashless functions 646 can be provided on a fifth server and security functions 650 can be provided on a sixth server. In this example, each server can communicate with a different combination of gaming devices because each of the functions provided by the servers may not be provided to every gaming device in the gaming system 600. For instance, the server 602 can be configured to provide progressive gaming functions to gaming devices 604, 652 and 656 but not gaming device 654. Thus, the server 602 may not communicate with the mobile gaming device 654 if progressive functions are not enabled on the mobile gaming device at a particular time.

Typically, each server can include an administrator interface that allows the functions of a server, such as 602, to be configured and maintained. Each server 602 can include a processor and memory. In some embodiments, the servers, such as 602, can include a game controller with components, such as but not limited to a power-hit tolerant memory 630, a trusted memory 632 and an RNG 634 described with respect to gaming device 604. The servers can include one or more network interfaces on which wired or wireless communication protocols can be implemented. Next, some possible functions provided by the server 602 are described. These functions are described for the purposes of illustration only and are not meant to be limiting.

The player interface support 636 can be used to serve content to gaming devices, such as 604, 652, 654 and 656, remote to the server. The content can include video and audio content that can be output on one of the player interfaces, such as 608, 652*a*, 654*a* and 656*a*. Further, the content can be configured to utilize unique features of a particular player interface, such as video displays, wheels or reels, if the particular player interface is so equipped.

In one embodiment, via the player interface support, content can be output to all or a portion of a primary video display that is used to output wager-based game outcomes on a player interface associated with a gaming device. For instance, a portion of the primary display can be allocated to providing a "service window" on the primary video display where the content in the service window is provided from a server remote to the gaming device. In particular embodiments, the content delivered from the server to a gaming device as part of the player interface support 636 can be affected by inputs made on the gaming device. For instance, the service window can be generated on a touch screen display where inputs received via the service window can be sent back to server 602. In response, to the received inputs, the server 602 can adjust the content that is displayed on the remote gaming device that generated the inputs.

The "service window" application can be generated by software code that is executed independently of other game controller software in a secure "sandbox." Via the sandbox, an executable can be given limited access to various resources on an EGM, such as a portion of the CPU resources and memory available on a game controller. The memory can be isolated from the memory used by other processes, such as game processes executed by the game controller.

As described above, a service window application can be allowed to control, send and/or receive data from secondary devices on a gaming device, such as a video display, a touch screen power interfaces or communication interfaces. A service window application allowed to utilize a communication interface, such as a wireless communication interface, can be configured to communicate with a portable electronic device via the communication interface. Thus, a service window application can be configured to implement attract features as described above independently of a game controller on an EGM. Further details of utilizing a service window on a gaming device on an EGM are described in U.S. patent application Ser. No. 12/209,608, by Weber et al., filed Sep. 12, 2008, titled "Gaming Machine with Externally Controlled Content Display," which is incorporated herein by reference in its entirety and for all purposes.

In another embodiment, via the video display, the service window application can be configured to output data in an optical image format, such as a 1-D/2-D bar-code or a QR code. The optically formatted data can be captured by a camera on the portable electronic device. For instance, a receipt indicating the acceptance of a virtual ticket voucher or virtual currency on the gaming device can be displayed in the service window in a QR code format and transferred to a user's portable electronic device via an image capture device on their portable electronic device. In another embodiment, virtual ticket voucher information can be transferred to a portable electronic device as optically formatted image data.

If a player's identity is known, then the player interface support 636 can be used to provide custom content to a remote gaming device, such as 604. For instance, a player can provide identification information, such as information indicating their membership in a loyalty program, during their utilization of a gaming device. The custom content can be selected to meet the identified player's interests. In one embodiment, the player's identity and interests can be managed via a loyalty program, such as via a loyalty program account associated with loyalty function 640. The custom content can include notifications, advertising and specific offers that are determined to be likely of interest to a particular player.

The gaming device software function 638 can be used to provide downloads of software for the game controller and/or second controllers associated with peripheral devices on a gaming device. For instance, the gaming device software 638 may allow an operator and/or a player to select a new game for play on a gaming device. In response to the game selection, the gaming device software function 638 can be used to download game software that allows a game controller to generate the selected game. In another example, in response to determining that a new counterfeit bill is being accepted by bill acceptors in the gaming system 600, the gaming device software function 638 can be used to download a new detection algorithm to the bill acceptors that allow the counterfeit bill to be detected.

The progressive gaming function 642 can be used to implement progressive game play on one or more gaming devices. In progressive game play, a portion of wagers associated with the play of a progressive game is allocated to a progressive jackpot. A group of gaming devices can be configured to support play of the progressive game and contribute to the progressive jackpot. In various embodiments, the gaming devices contributing to a progressive jackpot may be a group of gaming devices collocated near one another, such as a bank of gaming machines on a casino floor, a group of gaming devices distributed throughout a single casino, or group of gaming devices distributed throughout multiple casinos (e.g., a wide area progressive). The progressive gaming function 642 can be used to receive the jackpot contributions from each of the gaming devices participating in the progressive game, determine a current jackpot and notify participating gaming devices of the current progressive jackpot amount, which can be displayed on the participating gaming devices if desired.

The loyalty function 640 can be used to implement a loyalty program within a casino enterprise. The loyalty function 640 can be used to receive information regarding activities within a casino enterprise including gaming and non-gaming activities and associate the activities with particular individuals. The particular individuals can be known or may be anonymous. The loyalty function 640 can used to store a record of the activities associated with the particular individuals as well as preferences of the individuals if known. Based upon the information stored with the loyalty function 640 comps (e.g., free or discounted services including game play), promotions and custom contents can be served to the particular individuals.

The linked gaming function 644 can be used to used provide game play activities involving player participating as a group via multiple gaming devices. An example, a group of player might be competing against one another as part of a slot tournament. In another example, a group of players might be working together in attempt to win a bonus that can be shared among the players.

The cashless function 646 can enable the redemption and the dispensation of cashless instruments on a gaming device. For instance, via the cashless function, printed tickets, serving as a cashless instrument, can be used to transfer credits from one gaming device to another gaming device. Further, the printed tickets can be redeemed for cash. The cashless function can be used to generate identifying information that can be stored to a cashless instrument, such as a printed ticket, that allows the instrument to later be authenticated. After authentication, the cashless instrument can be used for additional game play or redeemed for cash.

The accounting function can receive transactional information from various gaming devices within the gaming system 600. The transactional information can relate to value deposited on each gaming device and value dispensed from each gaming device. The transactional information, which can be received in real-time, can be used to assess the performance of each gaming device as well as an overall performance of the gaming system. Further, the transactional information can be used for tax and auditing purposes.

The security function 650 can be used to combat fraud and crime in a casino enterprise. The security function 650 can be configured to receive notification of a security event that has occurred on a gaming device, such as an attempt at illegal access. Further, the security function 650 can receive transactional data that can be used to identify if gaming devices are being utilized in a fraudulent or unauthorized manner. The security function 650 can be configured to receive, store and analyze data from multiple sources including detection apparatus located on a gaming device and detection apparatus, such as cameras, distributed throughout a casino. In response to detecting a security event, the security function 650 can be configured to notify casino personnel of the event. For instance, if a security event is detected at a gaming device, a security department can be notified. Depending on the security event, one or more team members of the security department can be dispatched to the vicinity of the gaming device. Next, a perspective diagram of a slot-type gaming device that can include all or a portion of the components described with respect to gaming device 604 is described.

FIG. 11 shows a perspective drawing of a gaming device 700 in accordance with the described embodiments. The gaming device 700 is example of what can be considered a "thick-client." Typically, a thick-client is configurable to communicate with one or more remote servers but provides game play, such as game outcome determination, independent of the remote servers. In addition, a thick-client can be considered as such because it includes cash handling capabilities, such as peripheral devices for receiving cash, and a secure enclosure within the device for storing the received cash. In contrast, thin-client device, such as a mobile gaming device, may be more dependent on a remote server to provide a component of the game play on the device, such as game outcome determination, and/or may not include peripheral devices for receiving cash and an associated enclosure for storing it.

Many different configurations are possible between thick and thin clients. For instance, a thick-client device, such as 700, deployed in a central determination configuration, may receive game outcomes from a remote server but still provide cash handling capabilities. Further, the peripheral devices can vary from gaming device to gaming device. For instance, the gaming device 700 can be configured with electro-mechanical reels to display a game outcome instead of a video display, such as 710. Thus, the features of gaming device 700 are described for the purposes of illustration only and are not meant to be limiting.

The gaming device 700 can include a main cabinet 702. The main cabinet 702 can provide a secure enclosure that prevents tampering with the device components, such as a game controller (not shown) located within the interior of the main cabinet and cash handing devices including a coin acceptor 720, a ticket printer 726 and a bill acceptor 718. The main cabinet can include an access mechanism, such as door 704, which allows an interior of the gaming device 700 to be accessed. The actuation of the door 704 can be controlled by a locking mechanism, such as lock 716. The lock 716, the door 704 and the interior of the main cabinet 702 can be monitored with security sensors for detecting whether the interior has been accessed. For instance, a light sensor can be provided to detect a change in light-level in response to the door 704 being opened.

The interior of the main cabinet 700 can include additional secure enclosure, which can also be fitted with locking mechanisms. For instance, the game controller, such as game controller 606, shown in FIG. 10, can be secured within a separate locked enclosure. The separate locked enclosure for the game controller may allow maintenance functions to be performed on the gaming device, such as emptying a drop box for coins, emptying a cash box or replacing a device, while preventing tampering with the game controller. Further, in the case of device with a coin acceptor, 720, the separate enclosure can protect the electronics of the game controller from potentially damaging coin dust.

A top box 706 can be mounted to the top of the main cabinet 702. A number of peripheral devices can be coupled to the top box 706. In FIG. 11, a display device 708 and a candle device 714 are mounted to the top box 706. The display device 708 can be used to display information associated with game play on the gaming device 700. For instance, the display device 708 can be used to display a bonus game presentation associated with the play of a wager-based game (One or more bonus games are often features of many wager-based games). In another example, the display device 708 can be used to display information associated with a progressive game, such as one or more progressive jackpot amounts. In yet another example, the display device 708 can be used to display an attract feature that is intended to draw a potential player's attention to the gaming device 700 when it is not in use.

The candle device 714 can include a number of lighting elements. The lighting elements can be lit in different patterns to draw attention to the gaming device. For instance, one lighting pattern may indicate that service is needed at the gaming device 700 while another light pattern may indicate that a player has requested a drink The candle device 714 is typically placed at the top of gaming device 700 to increase its visibility. Other peripheral devices, including custom bonus devices, such as reels or wheels, can be included in a top box 706 and the example in FIG. 11 is provided for illustrative purposes only. For instance, some of the devices coupled to the main cabinet 702, such as printer 726, can be located in a different top box configuration.

The gaming device 700 provides a player interface that allows the play of a game, such as wager-based game. In this embodiment, the player interface includes 1) a primary video display 710 for outputting video images associated with the game play, 2) audio devices, such as 722, for outputting audio content associated with game play and possibly casino operations, 3) an input panel 712 for at least providing game play related inputs and 4) a secondary video display 708 for outputting video content related to the game play (e.g., bonus material) and/or the casino enterprise (e.g., advertising). In particular embodiments, one or both of the video displays, 708 and 710, can be equipped with a touch screen sensor and associated touch screen controller, for detecting touch inputs, such as touch inputs associated with the play of a game or a service window output to the display device.

The input panel 712 can include a number of electro-mechanical input buttons, such as 730, and/or touch sensitive surfaces. For instance, the input panel can include a touch screen equipped video display to provide a touch sensitive surface. In some embodiments, the functions of the electro-mechanical input buttons can be dynamically reconfigurable. For instance, the function of the electro-mechanical input buttons may be changed depending on the game that is being played on the gaming device. To indicate function changes, the input buttons can each include a configurable display, such as an e-ink or a video display for indicating the function of button. The output of the configurable display can be adjusted to account for a change in the function of the button.

The gaming device 700 includes a card reader 728, a printer 726, a coin acceptor 720, a bill and/or ticket acceptor 720 and a coin hopper (not shown) for dispensing coins to a coin tray 732. These devices can provide value input/output capabilities on the gaming device 700. For instance, the printer 726 can be used to print out tickets redeemable for cash or additional game play. The tickets generated by printer 726 as well as printers on other gaming devices can be inserted into bill and ticket acceptor 718 to possibly add credits to the gaming device 700. After the ticket is authenticated, credits associated with the ticket can be transferred to the gaming device 700.

The device 718 can also be used to accept cash bills. After the cash bill is authenticated, it can be converted to credits on the gaming device and used for wager-based game play. The coin acceptor 720 can be configured to accept coins that are legal tender or tokens, such as tokens issued by a casino enterprise. A coin hopper (not shown) can be used to dispense coins that are legal tender or tokens into the coin tray 732.

The various aspects, embodiments, implementations or features of the described embodiments can be used separately or in any combination. Various aspects of the described embodiments can be implemented by software, hardware or a combination of hardware and software. The computer readable medium is any data storage device that can store data which can thereafter be read by a computer system. Examples of the computer readable medium include read-only memory, random-access memory, CD-ROMs, DVDs, magnetic tape and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

While the embodiments have been described in terms of several particular embodiments, there are alterations, permutations, and equivalents, which fall within the scope of these general concepts. It should also be noted that there are many alternative ways of implementing the methods and apparatuses of the present embodiments. It is therefore intended that the following appended claims be interpreted as including all such alterations, permutations, and equivalents as fall within the true spirit and scope of the described embodiments.

What is claimed is:

1. A method in a wager-based electronic gaming machine (EGM) including a game controller, the method comprising:

initializing the EGM including establishing communications between a first electronic device and the game controller via a private local area network wherein access to a wide area network is not available to the EGM via the private local area network;

instantiating a game play mode wherein wager-based game play is available on the EGM;

sending accounting data associated with a play of a wager-based game to the electronic device only via the private local area network;

storing data to a data store wherein the data doesn't include the accounting data;

establishing a first secure communication connection with a mobile device;

establishing a second secure communication connection with a second electronic device located on a wide area network using wide area network capabilities provided by the mobile device;

sending via the first and the second secure communication connections the data in the data store to a second electronic device and ending the communication connections with the mobile device.

2. The method of claim 1, wherein the sending the accounting data, the storing the data, the establishing the first secure connection, the establishing the second secure connection and sending via the first and second secure communication connections are performed while the EGM is in the game play mode.

3. The method of claim 1, wherein the mobile device is controlled by a user currently engaged in wager-based game play on the EGM.

4. The method of claim 1, wherein the mobile device is controlled by an operator of the EGM.

5. The method of claim 1, further comprising: instantiating an operator mode on the EGM wherein the EGM is configured to only establish the second secure communication connection when the EGM is in the operator mode.

6. The method of claim 1, wherein a communication interface used to establish the first secure communication connection is located in an interior of an EGM cabinet and is only be used when the interior of the EGM cabinet is accessed.

7. The method of claim 6, wherein the second communication connection is only established via a mobile device coupled to the communication interface.

8. The method of claim 1, wherein the data in the data store is related to a fault condition that has occurred on the EGM.

9. The method of claim 1, wherein the data in the data store is a core dump from a game controller on the EGM.

10. The method of claim 1, wherein the data in the data store is usage data related to an amount of use of a peripheral device providing input or output capabilities on the EGM.

11. The method of claim 10, wherein the peripheral device is a mechanical button.

12. The method of claim 1, wherein the EGM is configured to only push the data from the data store to the second electronic device via the second secure communication connection.

13. The method of claim 1, wherein the wide area network is the Internet.

14. The method of claim 1, further comprising: determining whether the wide area networking capabilities are available on the mobile device.

15. The method of claim 1, further comprising: determining whether the mobile device is authorized for providing the second secure communication connection.

16. The method of claim 1, further comprising: sending a portion of the data in the data store via the second secure communication connection, ending communications with the mobile device, establishing secure communications with a second mobile device and sending a remaining portion of the data in the data store to the second electronic device via wide area networking capabilities provided by the second mobile device.

17. The method of claim 1, further comprising: establishing secure communications with a second mobile device while maintaining the secure communications with the first mobile device and sending a first portion of the data in the data store to the second electronic device via the first mobile device and a second portion of the data in the data store to the second electronic device via the second mobile device.

18. The method of claim 1, wherein the data in the data store including a plurality of data items and further comprising prioritizing which of the data items to send first to the second electronic device.

19. The method of claim 1, further comprising: determining a particular application is executing on the mobile device and only attempting to establish the second secure communication connection when the particular application is detected.

20. The method of claim 1, wherein the communications are ended with the mobile device when a person carrying the mobile device moves out of communication range with the EGM.

21. The method of claim 1, wherein the second secure communication connection is ended in response to detecting zero credits or receiving a cash-out command on the EGM.

22. The method of claim 1, further comprising: prior to establishing the secure second communication connection, receiving player tracking information from the mobile device wherein the player tracking is used to determine whether to establish the secure communication connection via the mobile device.

23. The method of claim 1, wherein the remote electronic device is controlled by a manufacturer of the EGM.

24. The method of claim 23, further comprising: sending EGM identification information to the remote electronic device that allows the manufacturer to identify the EGM as being manufactured by the manufacturer.

25. The method of claim 1, further comprising: receiving software or firmware via the first and the second communication connections for installation on the EGM.

26. The method of claim 1, wherein the data in the data store is used to establish a maintenance schedule for the EGM.

27. The method of claim 1, wherein the data in the data store is used to analyze a fault condition that has occurred on the EGM.

28. A wager-based electronic gaming machine (EGM) comprising:

a cabinet;

a first communication interface configured to communicate with a first electronic device via a private local area network wherein access to a wide area network is not available to the EGM via the private local area network;

a second communication interface configured to communicate with a mobile device;

a game controller including a processor and a memory, disposed within the cabinet and coupled to the first communication interface and the second communication interface, configured to 1) receive an input signal from an input device on the EGM indicating a wager on an outcome to a wager-based game; 2) determine the outcome to the wager-based game including an award amount; 3) generate a plurality of commands for controlling output devices coupled to the game controller to generate a presentation for the wager-based game that reveals the determined game outcome; 4) generate accounting data associated with coin-in and coin-out from the EGM; 5) send the accounting data to the first electronic device only via the private local network; 6) generate a fault condition when communications with the first electronic device can't be established; 7) store a plurality of data items to a data store wherein the data store is not allowed to receive the accounting data; 8) establish a temporary communication connection with a mobile device; 9) establish a communication connection over the Internet with a second electronic device via the temporary communication connection; and 10) send one or more of the plurality of data items to the second electronic via the mobile device.

29. The EGM of claim 28, wherein the mobile device is controlled by a user engaging in game play on the EGM.

* * * * *